US010021773B2

(12) United States Patent
Kuritsyn et al.

(10) Patent No.: US 10,021,773 B2
(45) Date of Patent: Jul. 10, 2018

(54) LASER PRODUCED PLASMA LIGHT SOURCE HAVING A TARGET MATERIAL COATED ON A CYLINDRICALLY-SYMMETRIC ELEMENT

(71) Applicant: KLA-Tencor Corporation, Milpitas, CA (US)

(72) Inventors: Alexey Kuritsyn, San Jose, CA (US); Brian Ahr, San Jose, CA (US); Rudy F. Garcia, Union City, CA (US); Frank Chilese, San Ramon, CA (US); Oleg Khodykin, San Diego, CA (US)

(73) Assignee: KLA-Tencor Corporation, Milpitas, CA (US)

( * ) Notice: Subject to any disclaimer, the term of this patent is extended or adjusted under 35 U.S.C. 154(b) by 0 days.

(21) Appl. No.: 15/265,515

(22) Filed: Sep. 14, 2016

(65) Prior Publication Data

US 2017/0142817 A1 May 18, 2017

Related U.S. Application Data

(60) Provisional application No. 62/255,824, filed on Nov. 16, 2015.

(51) Int. Cl.
*H05G 2/00* (2006.01)

(52) U.S. Cl.
CPC ..... *H05G 2/008* (2013.01)

(58) Field of Classification Search
CPC ..... H05G 2/00; H05G 2/001; H05G 2/003; H05G 2/005; H05G 2/006; H05G 2/008
(Continued)

(56) References Cited

U.S. PATENT DOCUMENTS 4,700,371 A * 10/1987 Forsyth ..... B82Y 10/00 250/492.2
4,866,517 A * 9/1989 Mochizuki ..... B82Y 10/00 378/119

(Continued)

FOREIGN PATENT DOCUMENTS

WO 2014161698 A1 10/2014
WO 2014168519 A1 10/2014
WO 2015055374 A1 4/2015

OTHER PUBLICATIONS

Amano, Laser-Plasma Extreme Ultraviolet Source Incorporating a Cryogenic Xe Target, Recent Advances in Nanofabrication Techniques and Applications (chapter 18), Dec. 2, 2011, 353-368, Intech, Japan / online.

(Continued)

*Primary Examiner* — Jason McCormack
(74) *Attorney, Agent, or Firm* — Suiter Swantz pc llo

(57) ABSTRACT

The present disclosure is directed to laser produced plasma light sources having a target material, such as Xenon, that is coated on the outer surface of a drum. Embodiments include bearing systems for rotating the drum that have structures for reducing leakage of contaminant material and/or bearing gas into the LPP chamber. Injection systems are disclosed for coating and replenishing target material on the drum. Wiper systems are disclosed for preparing the target material surface on the drum, e.g. smoothing the target material surface. Systems for cooling and maintaining the temperature of the drum and a housing overlying the drum are also disclosed.

10 Claims, 29 Drawing Sheets

(58) Field of Classification Search
USPC ..... 250/504 R
See application file for complete search history.

(56) References Cited

U.S. PATENT DOCUMENTS

| | | | | |
|---|---|---|---|---|
| 6,320,937 | B1 * | 11/2001 | Mochizuki | H05G 2/003 378/119 |
| 7,095,038 | B2 | 8/2006 | Barthod | |
| 7,247,870 | B2 | 7/2007 | Ershov | |
| 7,453,077 | B2 | 11/2008 | Bowering | |
| 7,655,925 | B2 | 2/2010 | Bykanov | |
| 7,671,349 | B2 | 3/2010 | Bykanov | |
| 7,812,329 | B2 | 10/2010 | Bykanov | |
| 8,198,615 | B2 | 6/2012 | Bykanov | |
| 8,258,485 | B2 | 10/2012 | Levesque | |
| 8,723,147 | B2 | 5/2014 | Abhari | |
| 8,963,110 | B2 | 2/2015 | Hale | |
| 2008/0006783 | A1 | 1/2008 | Hergenhan et al. | |
| 2010/0032590 | A1 | 11/2010 | Bykanov | |
| 2012/0050706 | A1 | 3/2012 | Levesque | |
| 2012/0107143 | A1 * | 5/2012 | Gilarranz | F04D 25/0606 417/53 |
| 2014/0085724 | A1 | 3/2014 | Chilese | |
| 2014/0166051 | A1 | 6/2014 | Umstadter | |
| 2014/0246607 | A1 | 9/2014 | Bykanov | |
| 2014/0306115 | A1 | 10/2014 | Kuritsyn | |
| 2014/0374611 | A1 | 12/2014 | Hale et al. | |
| 2014/0376842 | A1 | 12/2014 | Chilese | |
| 2015/0008335 | A1 * | 1/2015 | Bykanov | G03F 7/70033 250/428 |
| 2015/0076359 | A1 | 3/2015 | Bykanov | |

OTHER PUBLICATIONS

Amano, Laser-Plasma Debris from a Rotating Cryogenic-Solid-Xe Target, Rev Sci. Instrum. 81, 023104, Feb. 5, 2010, online.

Amano, Characterization of a Laser-Plasma Extreme-Ultraviolet Source using a Rotating Cryogenic Xe Target, Appl Phys B 101: 213-219 (2010), online.

Fukugaki, Rotating Cryogenic Drum Supplying Solid Xe Target to Generate Extreme Ultraviolet Radiation, Rev Sci. Instrum. 77, 063114, Jun. 27 2006, online.

* cited by examiner

LASER PRODUCED PLASMA LIGHT SOURCE HAVING A TARGET MATERIAL COATED ON A CYLINDRICALLY-SYMMETRIC ELEMENT

CROSS-REFERENCE TO RELATED APPLICATION

The present application is related to and claims the benefit of the earliest available effective filing date(s) from the following listed application(s) (the "Related Applications") (e.g., claims earliest available priority dates for other than provisional patent applications or claims benefits under 35 USC § 119(e) for provisional patent applications, for any and all parent, grandparent, great-grandparent, etc. applications of the Related Application(s)).

RELATED APPLICATIONS

For purposes of the USPTO extra-statutory requirements, the present application constitutes a regular (non-provisional) patent application of U.S. Provisional Patent Application entitled LASER PRODUCED PLASMA LIGHT SOURCE HAVING A TARGET MATERIAL COATED ON A CYLINDRICALLY-SYMMETRIC ELEMENT, naming Alexey Kuritsyn, Brian Ahr, Rudy Garcia, Frank Chilese, and Oleg Khodykin, as inventor, filed Nov. 16, 2015, Application Ser. No. 62/255,824.

TECHNICAL FIELD

The present disclosure relates generally to plasma-based light sources for generating light in the vacuum ultraviolet (VUV) range (i.e., light having a wavelength of approximately 100 nm-200 nm), extreme ultraviolet (EUV) range (i.e., light having a wavelength in the range of 10 nm-124 nm and including light having a wavelength of 13.5 nm) and/or soft X-ray range (i.e., light having a wavelength of approximately 0.1 nm-10 nm). Some embodiments described herein are high brightness light sources particularly suitable for use in metrology and/or mask inspection activities, e.g. actinic mask inspection and including blank or patterned mask inspection. More generally, the plasma-based light sources described herein can also be used (directly or with appropriate modification) as so-called high volume manufacturing (HVM) light sources for patterning chips.

BACKGROUND

Plasma-based light sources, such as laser-produced plasma (LPP) sources, can be used to generate soft X-ray, extreme ultraviolet (EUV), and/or vacuum ultraviolet (VUV) light for applications such as defect inspection, photolithography, or metrology. In overview, in these plasma light sources, light having the desired wavelength is emitted by plasma formed from a target material having an appropriate line-emitting or band-emitting element, such as Xenon, Tin, Lithium or others. For example, in an LPP source, a target material is irradiated by an excitation source, such as a pulsed laser beam, to produce plasma.

In one arrangement, the target material can be coated on the surface of a drum. After a pulse irradiates a small area of target material at an irradiation site, the drum, which is rotating and/or axially translating, presents a new area of target material to the irradiation site. Each irradiation pulse produces a crater in the layer of target material. These craters can be refilled with a replenishment system to provide a target material delivery system that can, in theory, present target material to the irradiation site indefinitely. Typically, the laser is focused to a focal spot that is less than about 100 μm in diameter. It is desirable that the target material be delivered to the focal spot with relatively high accuracy in order to maintain a stable optical source position.

In some applications, Xenon (e.g., in the form of a layer of Xenon ice formed on the surface of a drum) can offer certain advantages when used as a target material. For example, a Xenon target material irradiated by a 1 μm drive laser can be used to produce a relatively bright source of EUV light that is particularly suitable for use in a metrology tool or a mask/pellicle inspection tool. Xenon is relatively expensive. For this reason, it is desirable to reduce the amount of Xenon used, and in particular to reduce the amount of Xenon that is dumped into the vacuum chamber, such as Xenon lost due to evaporation or Xenon that is scraped from the drum to produce a uniform target material layer. This excess Xenon absorbs the EUV light and lowers the delivered brightness to the system.

For these sources, the light emanating from the plasma is often collected via a reflective optic, such as a collector optic (e.g., a near-normal incidence or grazing incidence mirror). The collector optic directs, and in some cases focuses, the collected light along an optical path to an intermediate location where the light is then used by a downstream tool, such as a lithography tool (i.e., stepper/scanner), a metrology tool or a mask/pellicle inspection tool.

For these light sources, an ultra-clean, vacuum environment is desired for the LPP chamber to reduce fouling of optics and other components and to increase the transmission of light (e.g., EUV light) from the plasma to the collector optic and then onward to the intermediate location. During operation of the plasma-based illumination system, contaminants including particulates (e.g., metal) and hydrocarbons or organics, such as offgas from grease can be emitted from various sources including, but not limited to, a target-forming structure and the mechanical components which rotate, translate and/or stabilize the structure. These contaminants can sometimes reach and cause photo-contamination-induced damage to the reflective optic, or damage/degrade the performance of other components, such as a laser input window or diagnostic filters/detectors/optics. In addition, if a gas bearing is used, the bearing gas, such as air, if released into the LPP chamber, can absorb EUV light, lowering EUV light source output.

With the above in mind, Applicants disclose a laser produced plasma light source having a target material coated on a cylindrically-symmetric element and corresponding methods of use.

SUMMARY

In a first aspect, a device is disclosed herein having a stator body; a cylindrically-symmetric element rotatable about an axis and having a surface coated with plasma-forming target material for irradiation by a drive laser to produce plasma in a laser produced plasma (LPP) chamber, the element extending from a first end to a second end; a gas bearing assembly coupling the first end of the cylindrically-symmetric element to the stator body, the gas bearing assembly establishing a bearing gas flow and having a system reducing leakage of bearing gas into the LPP chamber by introducing a barrier gas into a first space in fluid communication with the bearing gas flow; and a second bearing assembly coupling the second end of the cylindrically-symmetric element to the stator body, the second bearing also having a system reducing leakage of contaminant material from the second bearing into the LPP chamber by introducing a barrier gas into a second space in fluid communication with the second bearing.

In one embodiment, the second bearing assembly is a magnetic bearing and the contaminant material comprises contaminants such as particulates that are generated by the magnetic bearing. In another embodiment, the second bearing assembly is a greased bearing and the contaminant material comprises contaminants such as grease offgas and particulates that are generated by the greased bearing. In another embodiment, the second bearing assembly is a gas bearing assembly and the contaminant material is bearing gas.

In a particular embodiment of this aspect, the cylindrically-symmetric element is mounted on a spindle and the system reducing leakage of bearing gas into the LPP chamber comprises a first annular groove, in stator body or spindle, in fluid communication with the first space and arranged to vent the bearing gas from a first portion of the first space; a second annular groove, in the stator body or spindle, in fluid communication with the first space and arranged to transport a barrier gas, at a second pressure, into a second portion of the first space; and, a third annular groove, in the stator body or spindle, in fluid communication with the first space, the third annular groove disposed between the first and second annular grooves in an axial direction parallel to the axis; and, arranged to transport the bearing gas and the barrier gas out of a third portion of the first space to create, in the third portion, a third pressure less than the first pressure and the second pressure.

In one particular embodiment of this aspect, the cylindrically-symmetric element is mounted on a spindle and the system reducing leakage of contaminant material into the LPP chamber comprises a first annular groove, in the stator body or spindle, in fluid communication with the first space and arranged to vent contaminant material from a first portion of the first space; a second annular groove, in the stator body or spindle, in fluid communication with the first space and arranged to transport a barrier gas, at a second pressure, into a second portion of the first space; and, a third annular groove, in the stator body or spindle, in fluid communication with the first space, the third annular groove disposed between the first and second annular grooves in an axial direction parallel to the axis; and, arranged to transport the contaminant material and the barrier gas out of a third portion of the first space to create, in the third portion, a third pressure less than the first pressure and the second pressure.

For this aspect, the device can further comprise a drive unit at the first end of the cylindrically-symmetric element, the drive unit having a linear motor assembly for translating the cylindrically-symmetric element along the axis and a rotary motor for rotating the cylindrically-symmetric element about the axis.

For this aspect, the plasma-forming target material can be, but is not limited to, Xenon ice. Also, by way of example, the bearing gas can be Nitrogen, Oxygen, purified air, Xenon, Argon or a combination of these gasses. In addition, also by way of example, the barrier gas can be Xenon, Argon or a combination thereof.

In another aspect, a device is disclosed herein having a stator body; a cylindrically-symmetric element rotatable about an axis and having a surface coated with plasma-forming target material for irradiation by a drive laser to produce plasma in a laser produced plasma (LPP) chamber, the element extending from a first end to a second end; a magnetic liquid rotary seal coupling the first end of the element to the stator body; and a bearing assembly coupling the second end of the cylindrically-symmetric element to the stator body, the bearing having a system reducing leakage of contaminant material from the bearing into the LPP chamber by introducing a barrier gas into a space in fluid communication with the second bearing.

In one embodiment of this aspect, the second bearing assembly is a magnetic bearing and the contaminant material comprises contaminants such as particulates that are generated by the magnetic bearing. In another embodiment, the second bearing assembly is a greased bearing and the contaminant material comprises contaminants such as grease offgas and particulates that are generated by the greased bearing. In another embodiment, the second bearing assembly is a gas bearing assembly and the contaminant material is bearing gas.

In a particular embodiment of this aspect, the cylindrically-symmetric element is mounted on a spindle and the system reducing leakage of contaminant material into the LPP chamber comprises a first annular groove, in one of the stator body and the spindle, in fluid communication with the space and arranged to vent contaminant material from a first portion of the space; a second annular groove, in one of the stator body and the spindle, in fluid communication with the space and arranged to transport a barrier gas, at a second pressure, into a second portion of the space; and, a third annular groove, in one of the stator body and the spindle, in fluid communication with the space, the third annular groove disposed between the first and second annular grooves in an axial direction parallel to the axis; and, arranged to transport the contaminant material and the barrier gas out of a third portion of the space to create, in the third portion, a third pressure less than the first pressure and the second pressure.

For this aspect, the device can further comprise a drive unit at the first end of the cylindrically-symmetric element, the drive unit having a linear motor assembly for translating the cylindrically-symmetric element along the axis and a rotary motor for rotating the cylindrically-symmetric element about the axis. In one embodiment, the device includes a bellows to accommodate axial translation of the cylindrically-symmetric element relative to the stator body.

Also for this aspect, the plasma-forming target material can be, but is not limited to, Xenon ice. Also, by way of example, for the embodiment in which the second bearing assembly is a gas bearing assembly, the bearing gas can be Nitrogen, Oxygen, purified air, Xenon, Argon or a combination of these gasses. In addition, also by way of example, the barrier gas can be Xenon, Argon or a combination thereof.

In another aspect, a device is disclosed herein having a cylindrically-symmetric element rotatable about an axis and having a surface coated with a band of plasma-forming target material for irradiation by a drive laser to produce plasma; a subsystem for replenishing plasma-forming target material on the cylindrically-symmetric element; and a serrated wiper positioned to scrape plasma-forming target material on the cylindrically-symmetric element to establish a uniform thickness of plasma-forming target material.

In a particular embodiment of this aspect, the drive laser is a pulsed drive laser and a crater having a maximum diameter, D, is formed in the plasma-forming target material on the cylindrically-symmetric element after a pulse irradiation, and wherein the serrated wiper comprises at least two teeth, with each tooth having a length, L, in a direction parallel to the axis, with $L>3\times D$.

In one embodiment of this aspect, the device also includes a housing overlying the surface and formed with an opening to expose plasma-forming target material for irradiation by the drive laser; and a wiper establishing a seal between the housing and the plasma-forming target material.

In another aspect, a device is disclosed herein having a cylindrically-symmetric element rotatable about an axis and having a surface coated with a band of plasma-forming target material; a subsystem for replenishing plasma-form ing target material on the cylindrically-symmetric element; a wiper positioned to scrape plasma-forming target material on the cylindrically-symmetric element to establish a uniform thickness of plasma-forming target material; a housing overlying the surface and formed with an opening to expose plasma-forming target material for irradiation by a drive laser to produce plasma, and a mounting system for attaching the wiper to the housing and for allowing the wiper to be replaced without moving the housing relative to the cylindrically-symmetric element.

In another aspect, a device is disclosed herein having a cylindrically-symmetric element rotatable about an axis and having a surface coated with a band of plasma-forming target material; a subsystem for replenishing plasma-form ing target material on the cylindrically-symmetric element; a wiper positioned to scrape plasma-forming target material on the cylindrically-symmetric element at a wiper edge to establish a uniform thickness of plasma-forming target material; a housing overlying the surface and formed with an opening to expose plasma-forming target material for irradiation by a drive laser to produce plasma, and an adjustment system for adjusting a radial distance between the wiper edge and the axis, the adjustment system having an access point on an exposed surface of the housing.

In another aspect, a device is disclosed herein having a cylindrically-symmetric element rotatable about an axis and having a surface coated with a band of plasma-forming target material; a subsystem for replenishing plasma-form ing target material on the cylindrically-symmetric element; a wiper positioned to scrape plasma-forming target material on the cylindrically-symmetric element at a wiper edge to establish a uniform thickness of plasma-forming target material; a housing overlying the surface and formed with an opening to expose plasma-forming target material for irradiation by a drive laser to produce plasma, and an adjustment system for adjusting a radial distance between the wiper edge and the axis, the adjustment system having an actuator for moving the wiper in response to a control signal.

In another aspect, a device is disclosed herein having a cylindrically-symmetric element rotatable about an axis and having a surface coated with a band of plasma-forming target material; a subsystem for replenishing plasma-form ing target material on the cylindrically-symmetric element; a wiper positioned to scrape plasma-forming target material on the cylindrically-symmetric element at a wiper edge to establish a uniform thickness of plasma-forming target material; and a measurement system outputting a signal indicative of a radial distance between the wiper edge and the axis.

In an embodiment of this aspect, the measurement system comprises a light emitter and a light sensor.

In another aspect, a device is disclosed herein having a cylindrically-symmetric element rotatable about an axis and having a surface coated with a band of plasma-forming target material; a subsystem for replenishing plasma-forming target material on the cylindrically-symmetric element; a wiper mount; a master wiper for aligning the wiper mount; and an operational wiper positionable in the aligned wiper mount to scrape plasma-forming target material on the cylindrically-symmetric element at a wiper edge to establish a uniform thickness of plasma-forming target material.

In another aspect, a device is disclosed herein having a cylindrically-symmetric element rotatable about an axis and having a surface coated with a band of plasma-forming target material for irradiation by a drive laser to produce plasma; a subsystem for replenishing plasma-forming target material on the cylindrically-symmetric element; and a first heated wiper for wiping plasma-forming target material on the cylindrically-symmetric element at a first location to establish a uniform thickness of plasma-forming target material; and a second heated wiper for wiping plasma-forming target material on the cylindrically-symmetric element at a second location to establish a uniform thickness of plasma-forming target material, the second location being diametrically opposite the first location across the cylindrically-symmetric element.

In an embodiment of this aspect, the first and second heated wipers have contact surfaces made of a compliant material, or a wiper mounted in a compliant manner.

In one particular embodiment of this aspect, the device further includes a first thermocouple for outputting a first signal indicative of a temperature of the first heated wiper and a second thermocouple for outputting a second signal indicative of a temperature of the second heated wiper.

In another aspect, a device is disclosed herein having a cylindrically-symmetric element rotatable about an axis and having a surface coated with a band of Xenon target material; and a cryostat system for controllably cooling the Xenon target material to a temperature below 70 Kelvins to maintain a uniform Xenon target material layer on the cylindrically-symmetric element.

In one embodiment, the cryostat system is a liquid Helium cryostat system.

In a particular embodiment, the device can further include a sensor, such as a thermocouple, positioned in the cylindrically-symmetric element producing an output indicative of cylindrically-symmetric element temperature; and a system responsive to the sensor output to control a temperature of the cylindrically-symmetric element.

In an embodiment of this aspect, the device can also include a refrigerator to cool exhaust refrigerant for recycle.

In another aspect, a device is disclosed herein having a hollow, cylindrically-symmetric element rotatable about an axis and having a surface coated with a band of plasma-forming target material; a sensor positioned in the cylindrically-symmetric element producing an output indicative of cylindrically-symmetric element temperature; and a system responsive to the sensor output to control a temperature of the cylindrically-symmetric element.

In an embodiment of this aspect, the device includes a liquid Helium cryostat system for controllably cooling the Xenon target material to a temperature below 70 Kelvins to maintain a uniform Xenon target material layer on the cylindrically-symmetric element.

In one embodiment of this aspect, the sensor is a thermocouple.

In a particular embodiment of this aspect, the device includes a refrigerator to cool exhaust refrigerant for recycle.

In another aspect, a device is disclosed herein having a hollow, cylindrically-symmetric element rotatable about an axis and having a surface coated with a band of plasma-forming target material; and a cooling system having a cooling fluid circulating in a closed-loop fluid pathway, the pathway extending into the cylindrically-symmetric element to cool the plasma-forming target material.

In a particular embodiment of this aspect, the device includes a sensor, such as a thermocouple, positioned in the cylindrically-symmetric element producing an output indicative of cylindrically-symmetric element temperature; and a system responsive to the sensor output to control a temperature of the cylindrically-symmetric element.

In one embodiment of this aspect, the cooling system comprises a refrigerator on the closed-loop fluid pathway.

In an embodiment of this aspect, the cooling fluid comprises Helium.

In another aspect, a device is disclosed herein having a cylindrically-symmetric element rotatable about an axis and having a surface coated with a band of plasma-forming target material; and a housing overlying the surface and formed with an opening to expose plasma-forming target material for irradiation by a drive laser to produce plasma, the housing formed with an internal passageway to flow a cooling fluid through the internal passageway to cool the housing.

For this aspect, the cooling fluid can be air, water, clean dry air (CDA), Nitrogen, Argon, a coolant that has passed through the cylindrically-symmetric element, such as Helium or Nitrogen, or a liquid coolant cooled by a chiller (e.g., to a temperature less than 0 degrees Celsius or having sufficient capacity to remove excess heat from mechanical motion and laser irradiation (e.g., cooling to a temperature below ambient but above the condensation point of Xenon, for example, 10-30 degrees Celsius).

In another aspect, a device is disclosed herein having a cylindrically-symmetric element rotatable about an axis and coated with a layer of plasma-forming target material, the cylindrically-symmetric element translatable along the axis to define an operational band of target material for irradiation by a drive laser having a band height, h; and an injection system outputting a spray of plasma-forming target material from a fixed location relative to the cylindrically-symmetric element, the spray having a spray height, H, measured parallel to the axis, with $H<h$ to replenish craters formed in plasma-forming target material by irradiation from a drive laser.

In an embodiment of this aspect, the device further includes a housing overlying the layer of plasma-forming target material, the housing formed with an opening to expose plasma-forming target material for irradiation by the drive laser and the injection system has an injector mounted on the housing.

In one embodiment of this aspect, the injection system comprises a plurality of spray ports and in a particular embodiment, the spray ports are aligned in a direction parallel to the axis.

In another aspect, a device is disclosed herein having a cylindrically-symmetric element rotatable about an axis and coated with a layer of plasma-forming target material, the cylindrically-symmetric element translatable along the axis; and an injection system having at least one injector translatable in a direction parallel to the axis, the injection system outputting a spray of plasma-forming target material to replenish craters formed in plasma-forming target material by irradiation from a drive laser.

In one embodiment of this aspect, the axial translation of the injector and the cylindrically-symmetric element is synchronized.

In an embodiment of this aspect, the injection system comprises a plurality of spray ports and in a particular embodiment the spray ports are aligned in a direction parallel to the axis.

In another aspect, a device is disclosed herein having a cylindrically-symmetric element rotatable about an axis and coated with a layer of plasma-forming target material, the cylindrically-symmetric element translatable along the axis; and an injection system having a plurality of spray ports aligned in a direction parallel to the axis and a plate formed with an aperture, the aperture translatable in a direction parallel to the axis to selectively uncover at least one spray port to output a spray of plasma-forming target material to replenish craters formed in plasma-forming target material on the external surface by irradiation from a drive laser.

In an embodiment of this aspect, the movement of the aperture is synchronized with the cylindrically-symmetric element axial translation.

In some embodiments, a light source as described herein can be incorporated into an inspection system such as a blank or patterned mask inspection system. In an embodiment, for example, an inspection system may include a light source delivering radiation to an intermediate location, an optical system configured to illuminate a sample with the radiation, and a detector configured to receive illumination that is reflected, scattered, or radiated by the sample along an imaging path. The inspection system can also include a computing system in communication with the detector that is configured to locate or measure at least one defect of the sample based upon a signal associated with the detected illumination.

In some embodiments, a light source as described herein can be incorporated into a lithography system. For example, the light source can be used in a lithography system to expose a resist coated wafer with a patterned beam of radiation. In an embodiment, for example, a lithography system may include a light source delivering radiation to an intermediate location, an optical system receiving the radiation and establishing a patterned beam of radiation and an optical system for delivering the patterned beam to a resist coated wafer.

It is to be understood that both the foregoing general description and the following detailed description are exemplary and explanatory only and are not necessarily restrictive of the present disclosure. The accompanying drawings, which are incorporated in and constitute a part of the specification, illustrate the subject matter of the disclosure. Together, the descriptions and the drawings serve to explain the principles of the disclosure.

BRIEF DESCRIPTION OF THE DRAWINGS

The numerous advantages of the disclosure may be better understood by those skilled in the art by reference to the accompanying figures in which.

DETAILED DESCRIPTION OF THE INVENTION

Reference will now be made in detail to the subject matter disclosed, which is illustrated in the accompanying drawings.

Figure 1:
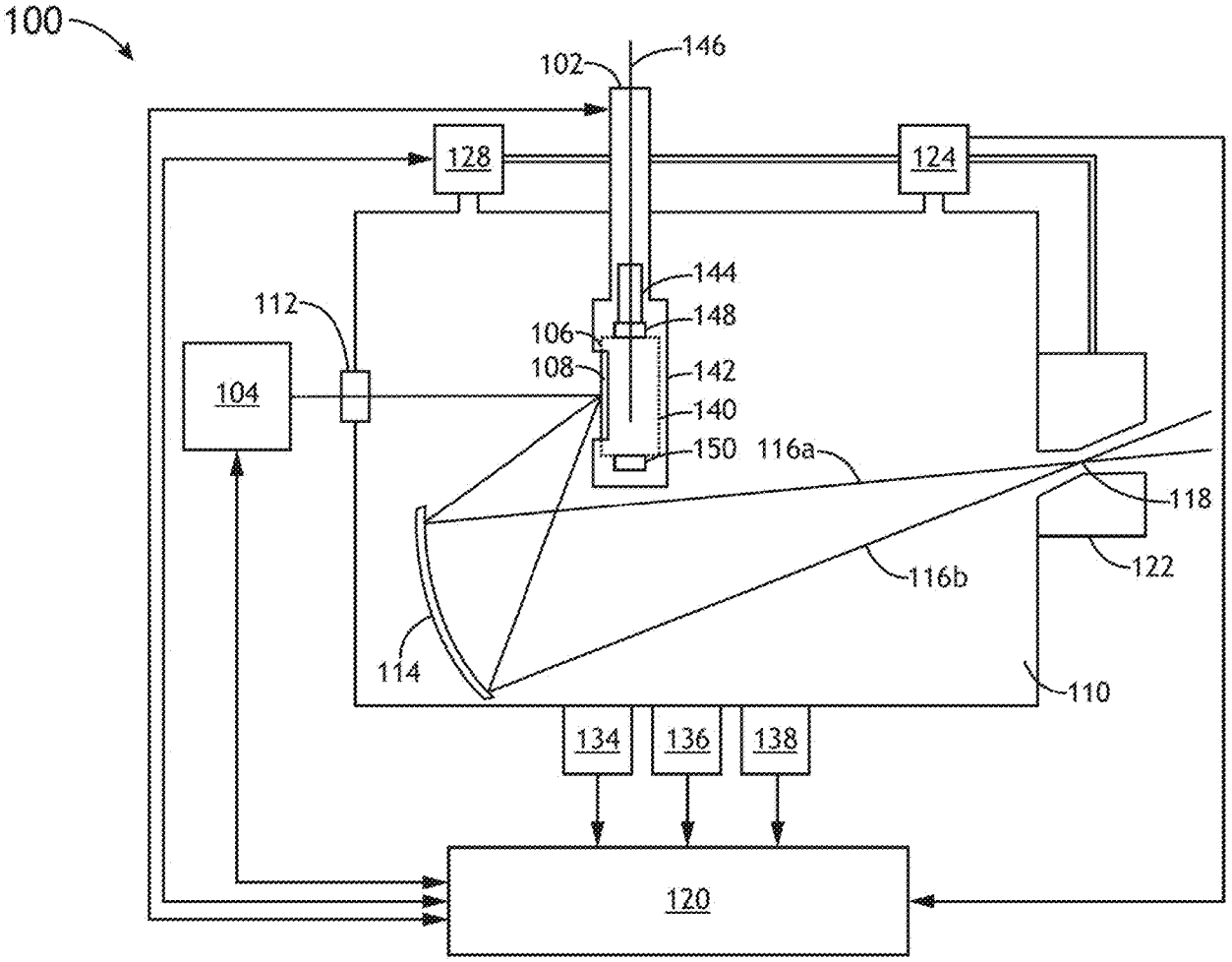
FIG. 1 is a simplified schematic diagram illustrating an LPP light source having a target material coated on a rotatable, cylindrically-symmetric element in accordance with an embodiment of this disclosure.

FIG. 1 shows an embodiment of a light source (generally designated 100) for producing extreme ultraviolet (EUV) light and a target material delivery system 102. For example, the light source 100 may be configured to produce in-band EUV light (e.g., light having a wavelength of 13.5 nm with 2% bandwidth). As shown, the light source 100 includes an excitation source 104, such as a drive laser, configured to irradiate a target material 106 at an irradiation site 108 to produce an EUV light emitting plasma in a laser produced plasma (LLP) chamber 110. In some cases, the target material 106 may be irradiated by a first pulse (pre-pulse) followed by a second pulse (main pulse) to produce plasma. As an example, for a light source 100 that is configured for actinic mask inspection activities, an excitation source 104 consisting of a pulsed drive laser having a solid state gain media such as Nd:YAG outputting light at approximately 1 μm and a target material 106 including Xenon may present certain advantages in producing a relatively high brightness EUV light source useful for actinic mask inspection. Other drive lasers having a solid state gain media such as Er:YAG, Yb:YAG, Ti:Sapphire or Nd:Vanadate may also be suitable. Gas-discharge lasers, including excimer lasers, may also be used if they provide sufficient output at the required wavelength. An EUV mask inspection system may only require EUV light in the range of about 10 W, though with high brightness in a small area. In this case, to generate EUV light of sufficient power and brightness for a mask inspection system, total laser output in the range of a few kilowatts may be suitable, which output is focused onto a small target spot, typically less than about 100 μm in diameter. On the other hand, for high volume manufacturing (HVM) activities such as photolithography, an excitation source 104 consisting of a drive laser having a high power gas-discharge $CO_2$ laser system with multiple amplification stages and outputting light at approximately 10.6 μm and a target material 106 including Tin may present certain advantages including the production of in-band EUV light with relatively high power with good conversion efficiency.

Continuing with reference to FIG. 1, for the light source 100, the excitation source 104 can be configured to irradiate the target material 106 at an irradiation site 108 with a focused beam of illumination or a train of light pulses delivered through a laser input window 112. As further shown, some of the light emitted from the irradiation site 108, travels to a collector optic 114 (e.g., near normal incidence mirror) where it is reflected as defined by extreme rays 116*a* and 116*b* to an intermediate location 118. The collector optic 114 can be a segment of a prolate spheroid having two focal points having a high-quality polished surface coated with a multilayer mirror (e.g., Mo/Si or NbC/Si) optimized for in-band EUV reflection. In some embodiments, the reflective surface of the collector optic 114 has a surface area in the range of approximately 100 to 10,000 $cm^2$ and may be disposed approximately 0.1 to 2 meters from the irradiation site 108. Those skilled in the art will appreciate that the foregoing ranges are exemplary and that various optics may be used in place of, or in addition to, the prolate spheroid mirror for collecting and directing light to an intermediate location 118 for subsequent delivery to a device utilizing EUV illumination, such as an inspection system or a photolithography system.

For the light source 100, LPP chamber 110 is a low pressure container in which the plasma that serves as the EUV light source is created and the resulting EUV light is collected and focused. EUV light is strongly absorbed by gases, thus, reducing the pressure within LPP chamber 110 reduces the attenuation of the EUV light within the light source 100. Typically, an environment within LPP chamber 110 is maintained at a total pressure of less than 40 mTorr and a partial pressure of Xenon of less than 5 mTorr to allow EUV light to propagate without being substantially absorbed. A buffer gas, such as Hydrogen, Helium, Argon, or other inert gases, may be used within the vacuum chamber.

As further shown in FIG. 1, the EUV beam at intermediate location 118 can be projected into internal focus module 122 which can serve as a dynamic gas lock to preserve the low-pressure environment within LPP chamber 110, and protect the systems that use the resulting EUV light from any debris generated by the plasma creation process.

Light source 100 can also include a gas supply system 124 in communication with control system 120, which can provide protective buffer gas(ses) into LPP chamber 110, can supply buffer gas to protect the dynamic gas lock function of internal focus module 122, can provide target material such as Xenon (as a gas or liquid) to target material delivery system 102, and can provide barrier gas to target material delivery system 102 (see further description below). A vacuum system 128 in communication with control system 120 (e.g., having one or more pumps) can be provided to establish and maintain the low pressure environment of LPP chamber 110 and can provide pumping to target material delivery system 102, as shown (see further description below). In some cases, target material and/or buffer gas(ses) recovered by the vacuum system 128 can be recycled.

Continuing with reference to FIG. 1, it can be seen that light source 100 can include a diagnostic tool 134 for imaging the EUV plasma and an EUV power meter 136 can be provided to measure the EUV light power output. A gas monitoring sensor 138 can be provided to measure the temperature and pressure of the gas within LPP chamber 110. All of the foregoing sensors can communicate with the control system 120, which can control real-time data acquisition and analysis, data logging, and real-time control of the various EUV light source sub-systems, including the excitation source 104 and target material delivery system 102.

FIG. 1 also shows that the target material delivery system 102 includes a cylindrically-symmetric element 140. In one embodiment, the rotatable, cylindrically-symmetric element 140 includes a cylinder, as shown in FIG. 1. In other embodiments, the rotatable, cylindrically-symmetric element 140 includes any cylindrically symmetric shape in the art. For example, the rotatable, cylindrically-symmetric element 140 may include, but is not limited to, a cylinder, a cone, a sphere, an ellipsoid and the like. Further, the cylindrically-symmetric element 140 may include a composite shape consisting of two or more shapes. In an embodiment, the rotatable, cylindrically-symmetric element 140 can be cooled and coated with a band of Xenon ice target material 106 that extends, laterally, around the circumference of the cylindrically-symmetric element 140. Those skilled in the art will appreciate that various target materials and deposition techniques may be used without departing from the scope of this disclosure. The target material delivery system 102 can also include a housing 142 overlying and substantially conforming to the surface of the cylindrically-symmetric element 140. The housing 142 can function to protect the band of target material 106 and facilitate the initial generation, maintenance and replenishment of the target material 106 on the surface of the cylindrically-symmetric element 140. As shown, housing 142 is formed with an opening to expose plasma-forming target material 106 for irradiation by a beam from the excitation source 104 to produce plasma at the irradiation site 108. The target material delivery system 102 also includes a drive unit 144 to rotate the cylindrically-symmetric element 140 about axis 146 and relative to the stationary housing 142 and translate the cylindrically-symmetric element 140, back and forth, along the axis 146 and relative to the stationary housing 142. Drive side bearing 148 and end bearing 150 couple the cylindrically-symmetric element 140 and stationary housing 142 allowing the cylindrically-symmetric element 140 to rotate relative to the stationary housing 142. With this arrangement, the band of target material 106 can be moved relative to the drive laser focal spot to sequentially present a series of new target material 106 spots for irradiation. Further details regarding target material support systems having a rotatable cylindrically-symmetric elements are provided in U.S. patent application Ser. No. 14/335,442, titled "System And Method For Generation Of Extreme Ultraviolet Light", to Bykanov et al., filed Jul. 18, 2014 and U.S. patent application Ser. No. 14/310,632, titled "Gas Bearing Assembly for an EUV Light Source", to Chilese et al., filed Jun. 20, 2014, the entire contents of each of which are hereby incorporated by reference herein.

Figure 2:
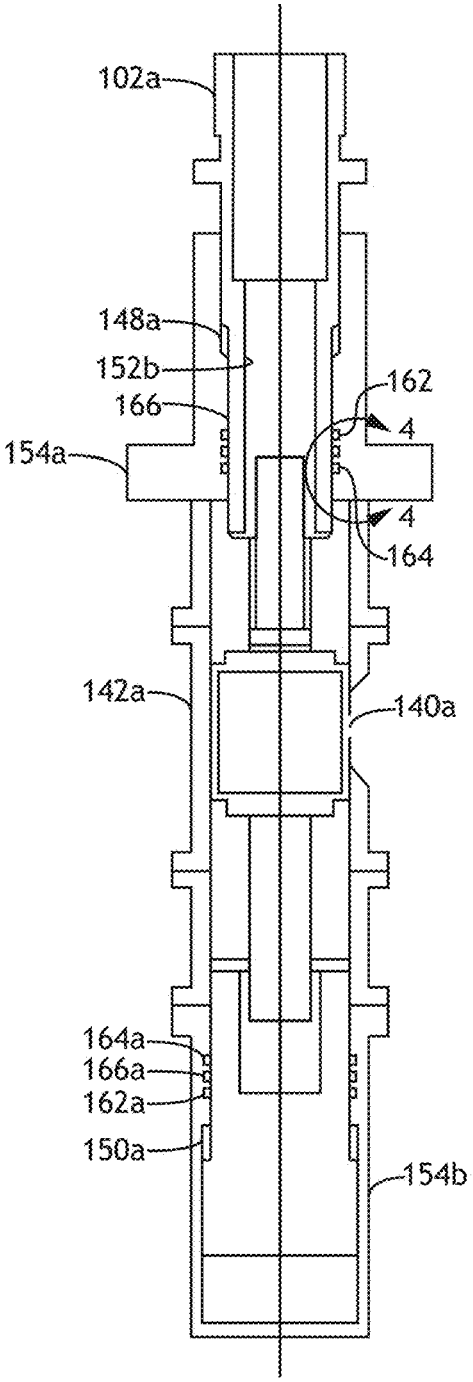
FIG. 2 is a sectional view of a portion of a target material delivery system having a drive side gas bearing and an end side gas bearing.
Figure 3:
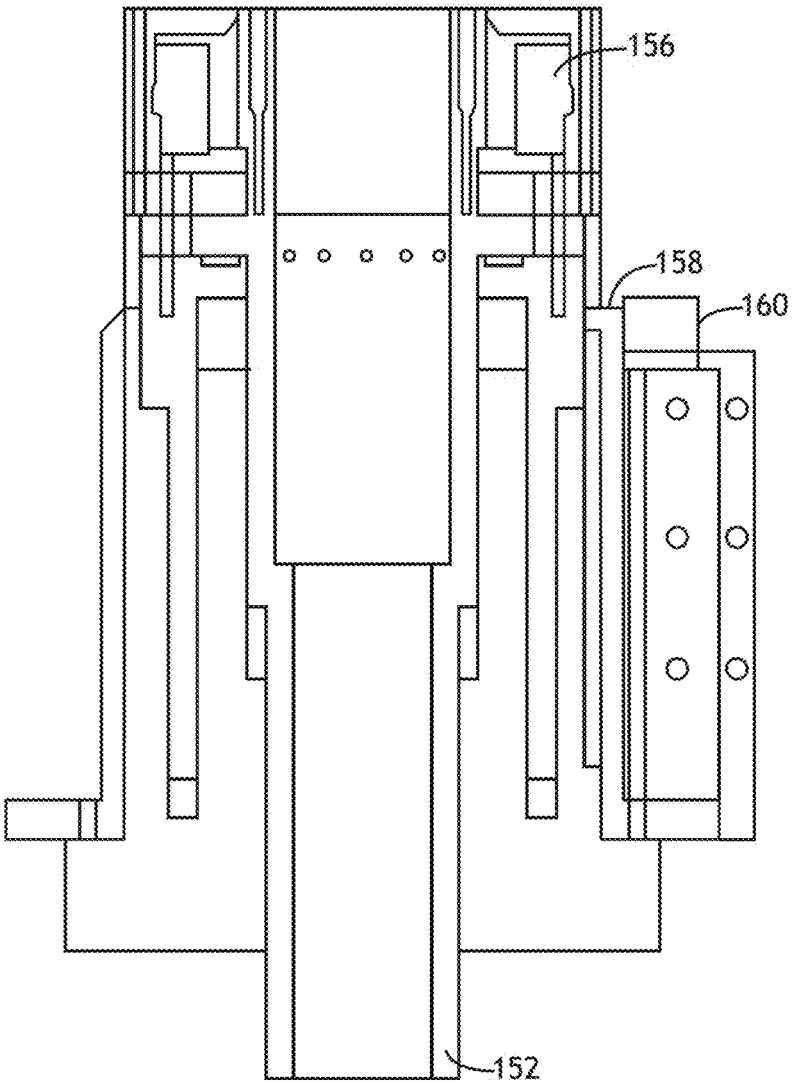
FIG. 3 is a perspective sectional view of a drive unit for rotating and axially translating a cylindrically-symmetric element.

FIG. 2 shows a portion of a target material delivery system 102*a* for use in the light source 100 having a drive side gas bearing 148*a* and end gas bearing 150*a* coupling cylindrically-symmetric element 140*a* and stationary housing 142*a* allowing the cylindrically-symmetric element 140*a* to rotate relative to the stationary housing 142*a*. More specifically, as shown, gas bearing 148*a* couples spindle 152 (which is attached to cylindrically-symmetric element 140*a*) to stator 154*a* (which is attached to stationary housing 142*a*). As shown in FIG. 3, the spindle 152 is attached to a rotary motor 156 which rotates the spindle 152 and cylindrically-symmetric element 140*a* (see FIG. 2) relative to the stationary housing 142*a*. FIG. 3 also shows that the spindle 152 is attached to a translational housing 158 which can be translated axially by linear motor 160. The use of bearings on both sides of the cylindrically-symmetric element 140*a* (i.e., a drive side gas bearing 148*a* and end gas bearing 150*a*) can, in some cases, increase mechanical stability of the target material delivery system 102 (FIG. 1) increase positional stability of the target material 106 and improve light source 100 efficiency. In addition, for systems with only a single air bearing (i.e., no end side bearing) forces exerted by the wipers on the cryogenically cooled drum covered with a Xenon ice layer can exceed the maximum stiffness that air-bearings are rated for and lead to their failure. The counter-balancing force in the bearing comes from the fact that when the drum shaft pivots (in the first approximation around the middle of the air bearing) the gas pressure on one side goes up while the gas pressure on the other side goes down. The resultant restoration force attempts to return the drum to the equilibrium position. However, the impulse force from the wipers should not exceed the maximum air-bearing stiffness. For example, if the maximum force the air bearing can sustain is ~1000 N, and if the level arm of the wiper torque is about 10 times larger than the arm for the counter-balance torque produced by the bearing, the total force from the wipers should be >10× smaller (<100N). In some situations, the wipers can produce larger force because they compress the Xenon ice radially against the cylinder surface. As described below, serrated wipers or the use of two, opposed compliant wipers can reduce the forces generated by a wiper system.

Figure 4:
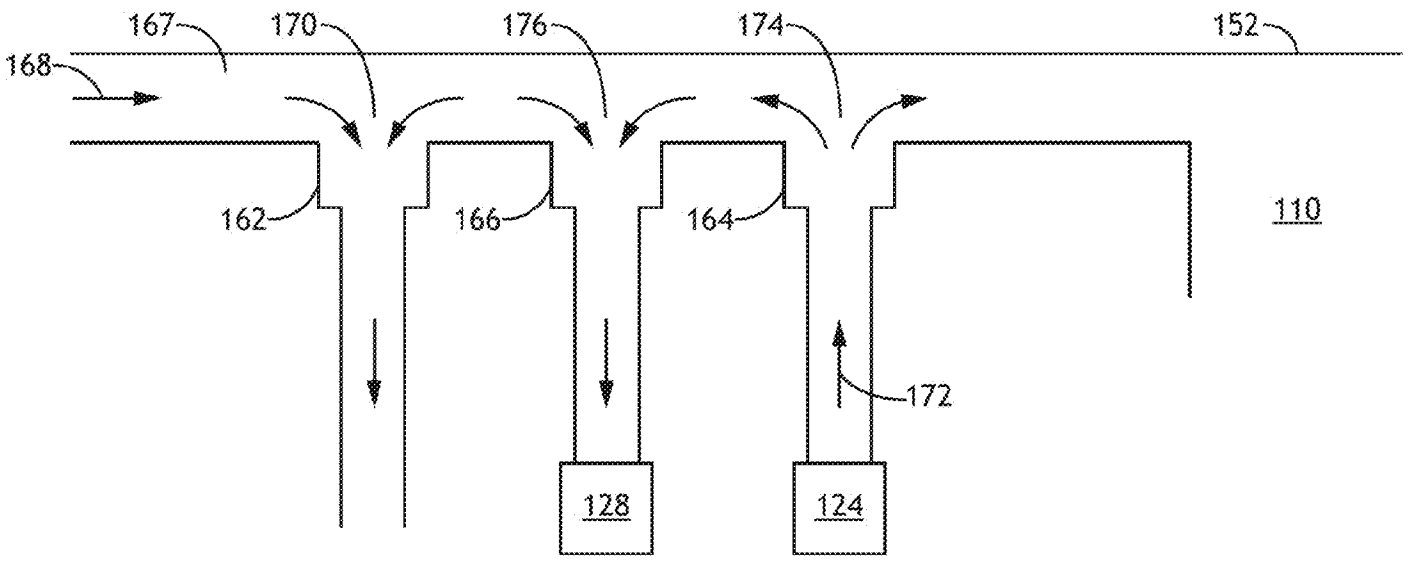
FIG. 4 is a detail view as enclosed by arrow 4-4 in FIG. 2 showing a system having a barrier gas for reducing leakage of bearing gas from a gas bearing.

Cross-referencing FIGS. 2 and 4, it can further be seen that the gas bearing 148*a* has a system for reducing leakage of bearing gas (e.g., into the LPP chamber 110 as shown in FIG. 1) consisting of a set of grooves 162, 164, 166 that are formed on a surface of stator 154*a*. As shown, space 167 is disposed between spindle 152 and stator body 154*a* and receives bearing gas flow 168 at pressure P1. Annular groove 162 is formed in stator body 154*a* and is in fluid communication with space 167 and functions to vent bearing gas flow 168 from portion 170 of space 167. Annular groove 164 is formed in stator body 154*a* and is in fluid communication with first space 167 and functions to transport barrier gas flow 172, at pressure P2, from gas supply system 124 into portion 174 of space 167. In an example embodiment, annular groove 164 is disposed proximate LPP chamber 110 in an axial direction parallel to axis 146 (see FIG. 1). Barrier gas may comprise Argon or Xenon, and it is selected for acceptability in LPP chamber 110. Annular groove 166 is arranged in stator body 154*a* is in fluid communication with space 167 and is disposed between annular groove 162 and annular groove 164, as shown. Annular groove 166 functions to transport the bearing gas and the barrier gas out of portion 176 of space 167 via vacuum system 128 creating a pressure P3 in portion 176 that is less than the first pressure, P1, and is less than the second pressure P2. The sequential extraction and blocking of bearing gas provided by the three annular grooves 162, 164, 166 can substantially reduce the amount of bearing gas that enters LPP chamber 110. Further details regarding the arrangement shown in FIG. 4 including example dimensions and working pressures can be found in U.S. patent application Ser. No. 14/310,632, titled "Gas Bearing Assembly for an EUV Light Source", to Chilese et al., filed Jun. 20, 2014, the entire contents of which were previously incorporated by reference herein.

FIG. 2 further shows that end gas bearing 150*a* couples spindle portion 152*b* (which is attached to cylindrically-symmetric element 140*a*) to stator 154*b* (which is attached to stationary housing 142*a*). It can also be seen that the gas bearing 150*a* has a system for reducing leakage of bearing gas (e.g., into the LPP chamber 110 as shown in FIG. 1) consisting of a set of grooves 162*a*, 164*a*, 166*a* that are formed on a surface of stator 154*b*. For example, grooves 162*a* may be a so-called 'vent groove', groove 164*a* may be a so-called 'shield gas groove' and groove 166*a* may be a so-called 'scavenger groove'. It is to be appreciated that grooves 162*a*, 164*a*, 166*a* function the same as corresponding grooves 162, 164, 166 described above and shown in FIG. 4, with groove 162*a* providing a vent, groove 164*a* in fluid communication with barrier gas supply 124 and groove 166*a* in fluid communication with vacuum system 128.

Figure 5:
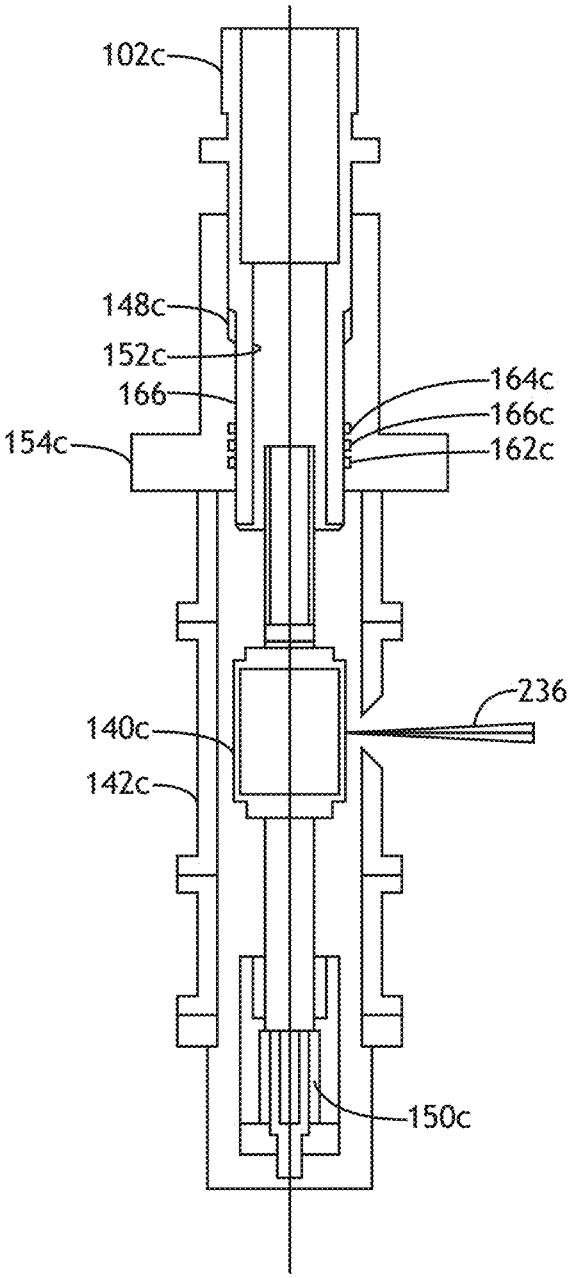
FIG. 5 is a sectional view of a portion of a target material delivery system having a drive side gas bearing and an end side bearing that is a magnetic or mechanical bearing.
Figure 6:
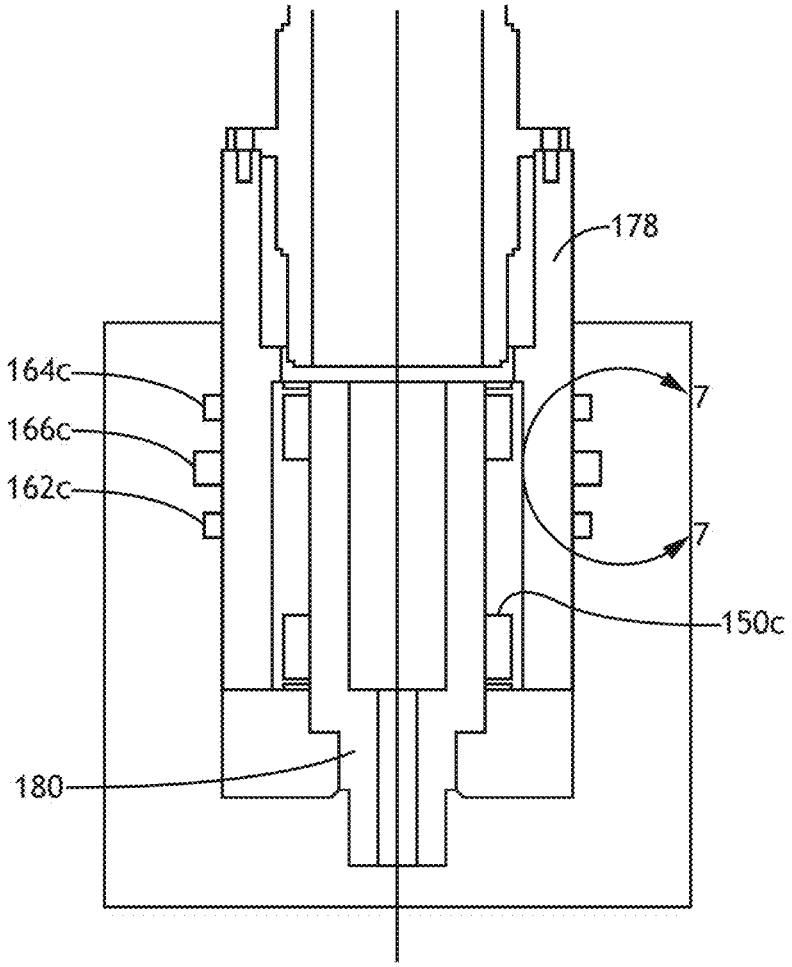
FIG. 6 is an enlarged view of the end side bearing for the embodiment shown in FIG. 5.

FIGS. 5 and 6 show a portion of a target material delivery system 102*c* for use in the light source 100 having a drive side gas bearing 148*c* coupling spindle 152*c* (which is attached to cylindrically-symmetric element 140*c*) to stator 154*c* and a magnetic or mechanical (i.e., greased) bearing 150*c* which couples bearing surface shaft 180 (which is attached to stationary housing 142*c*) and bearing coupling shaft 178 (which is attached to cylindrically-symmetric element 140*c*). It can also be seen that the gas bearing 148*c* has a system for reducing leakage of bearing gas (e.g., into the LPP chamber 110 as shown in FIG. 1) consisting of a set of grooves 162*c*, 164*c*, 166*c* that are formed on a surface of stator 154*c*. It is to be appreciated that grooves 162*c*, 164*c*, 166*c* function the same as corresponding grooves 162, 164, 166 described above and shown in FIG. 4, with groove 164*c* providing a vent, groove 164*c* in fluid communication with barrier gas supply 124, and groove 166*c* in fluid communication with vacuum system 128.

Figure 7:
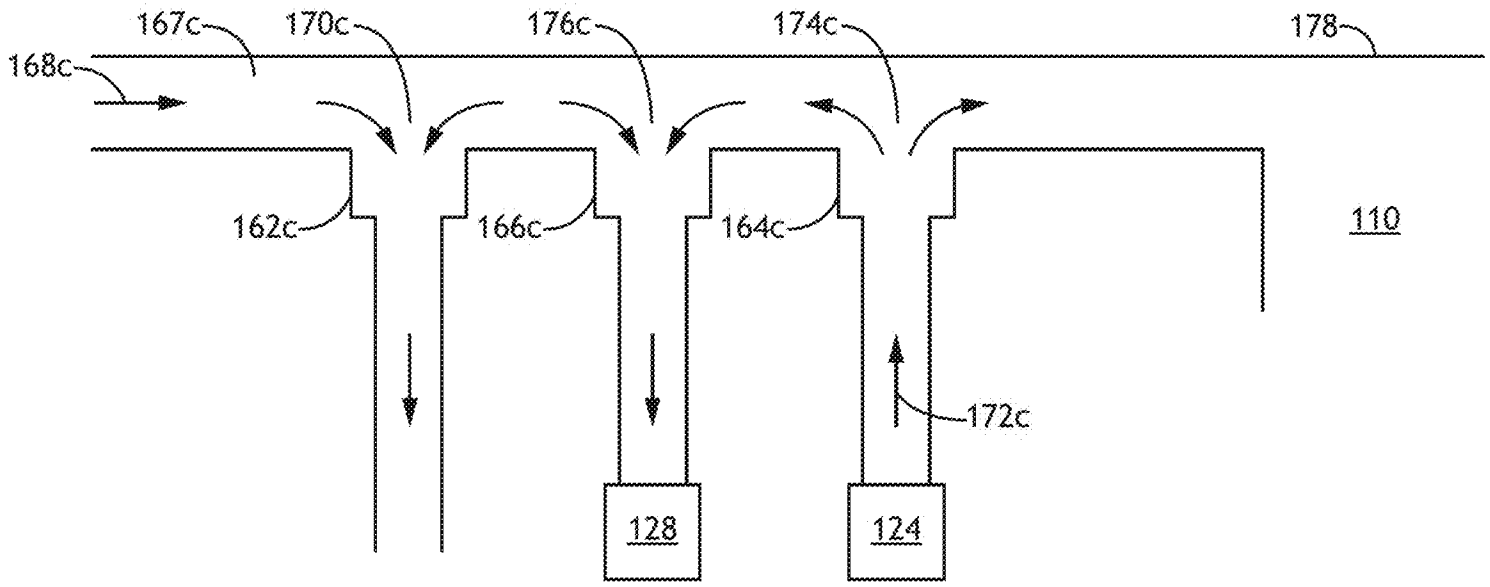
FIG. 7 is a detail view as enclosed by arrow 7-7 in FIG. 6 showing a system having a barrier gas for reducing leakage of bearing gas from a gas bearing.

Cross-referencing FIGS. 6 and 7, it can be seen that the magnetic or mechanical (i.e., greased) bearing 150*c* has a system for reducing leakage of contaminant materials into the LPP chamber 110 (shown in FIG. 1). These contaminant materials can include particulates and/or grease offgas generated by the bearing 150*c*. As shown, the system for reducing leakage of contaminant materials includes a set of grooves 162*c*, 164*c*, 166*c* that are formed on a surface of stationary housing 142*c*. As shown, space 167*c* is disposed between bearing coupling shaft 178 and stationary housing 142*c* and receives a flow 168*c* of gas at pressure P1 which can include contaminant materials. Annular groove 162*c* is formed in stationary housing 142*c* and is in fluid communication with space 167*c* and functions to vent the flow 168*c* from portion 170*c* of space 167*c*. Annular groove 164*c* is formed in stationary housing 142*c* and is in fluid communication with first space 167*c* and functions to transport barrier gas flow 172*c*, at pressure P2, from gas supply system 124 into portion 174*c* of space 167*c*. In an example embodiment, annular groove 164*c* is disposed proximate LPP chamber 110 in an axial direction parallel to axis 146 (see FIG. 1). Barrier gas may comprise Argon or Xenon, and it is selected for acceptability in LPP chamber 110. Annular groove 166*c* is arranged in stationary housing 142*c* is in fluid communication with space 167*c* and is disposed between annular groove 162*c* and annular groove 164*c*, as shown. Annular groove 166*c* functions to transport contaminant materials and the barrier gas out of portion 176*c* of space 167*c* via vacuum system 128 creating a pressure P3 in portion 176*c* that is less than the first pressure, P1, and is less than the second pressure P2. The sequential extraction and blocking of gas including contaminant materials provided by the three annular grooves can substantially reduce the amount of contaminant materials that enter LPP chamber 110.

Figure 8:
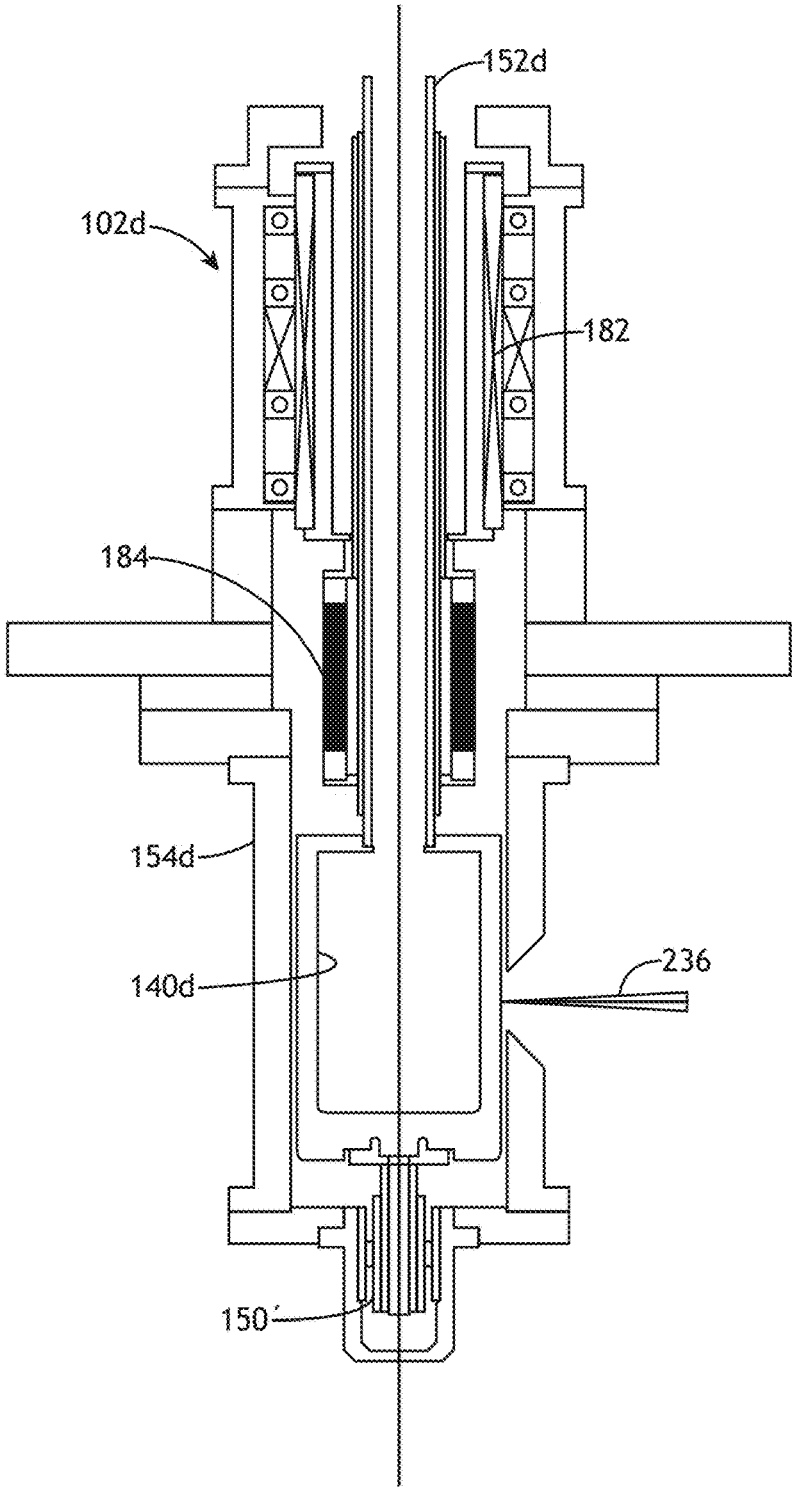
FIG. 8 is a simplified, sectional view of a portion of a target material delivery system having a drive side magnetic liquid rotary seal coupling a spindle to a stator.

FIG. 8 shows a portion of a target material delivery system 102*d* for use in the light source 100 (shown in FIG. 1) having a magnetic liquid rotary seal 182 which cooperates with a bellows 184 to couple spindle 152*d* (which is attached to cylindrically-symmetric element 140*d*) to stator 154*d*. For example, the seal 182 may be a magnetic liquid rotary sealing mechanism made by the Ferrotec (USA) Corporation headquartered in Santa Clara, Calif., which maintains a hermetic seal by means of a physical barrier in the form of a ferrofluid that is suspended in place by use of a permanent magnet. For this embodiment, the end side bearing 150' (shown schematically in FIG. 8) can be a gas bearing 150*a* as shown in FIG. 2 (having a system for reducing leakage of bearing gas) or a magnetic or mechanical (i.e., greased) bearing 150*c* as shown in FIG. 6 (having a system for reducing leakage of contaminant materials such as particulates and/or grease offgas).

Figure 9:
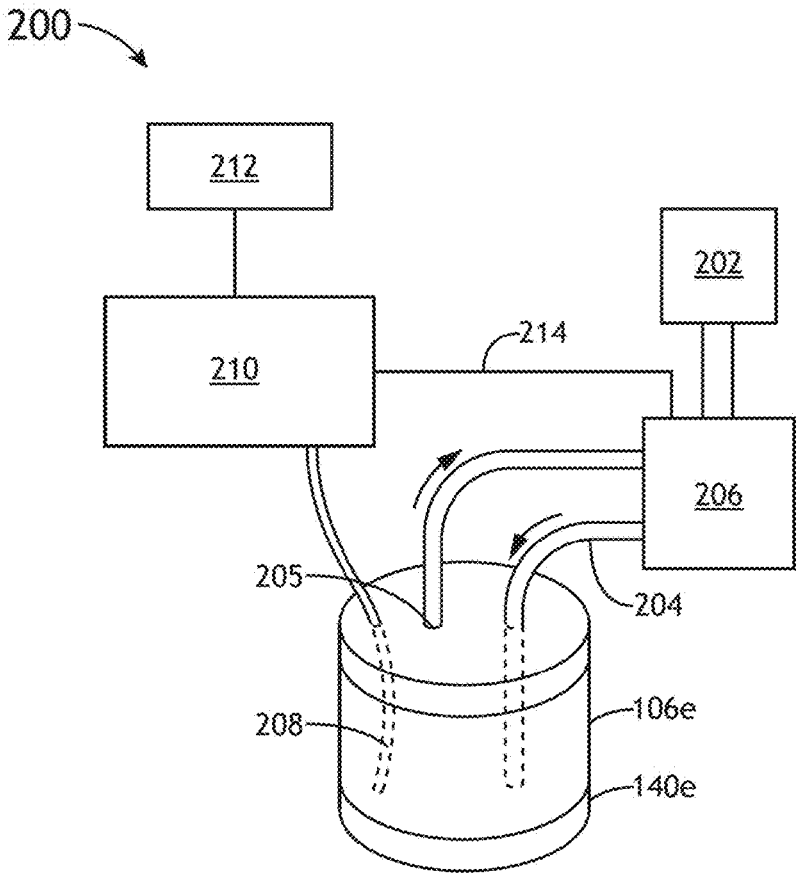
FIG. 9 is a schematic view of a system for cooling a cylindrically-symmetric element.

FIG. 9 shows a system 200 for cooling target material, such as frozen Xenon 106*e*, that has been coated on a cylindrically-symmetric element 140*e* to a temperature below about 70 Kelvins (i.e., below the boiling point of Nitrogen) to maintain a uniform layer of Xenon target material 106*e* on the cylindrically-symmetric element 140*e*. For example, the system 200 can include a liquid Helium cryostat system. As shown, a refrigerant source 202 supplies refrigerant (e.g., Helium) to a closed-loop fluid pathway 204 which extends into hollow, cylindrically-symmetric element 140*e* to cool the plasma-forming target material 106*e*. Refrigerant leaving the cylindrically-symmetric element 140*e* through port 205 on the pathway 204 is directed to a refrigerator 206 which cools the refrigerant and directs the cooled, recycled refrigerant back to the cylindrically-symmetric element 140*e*. FIG. 9 also shows that the system 200 can include a temperature control system having a sensor 208, which can include, for example, one or more thermocouples, that are disposed on or within the hollow cylindrically-symmetric element 140*e* to produce an output indicative of the temperature of cylindrically-symmetric element 140*e*. Controller 210 receives the output of sensor 208 and a temperature set point from user input 212. For example, the controller can be used to choose a temperature set point all the way down to the liquid helium temperature. For the devices described herein, controller 210 can be part of or in communication with control system 120 shown in FIG. 1 and described above. Controller 210 uses the sensor 208 output and temperature set point to produce a control signal that is communicated to refrigerator 206 via line 212 to control the temperature of the cylindrically-symmetric element 140*e* and Xenon target material 106*e*.

In some cases, the use of a coolant to cool the cylindrically-symmetric element 140*e* to a temperature below about 70 Kelvins (i.e., below the boiling point of Nitrogen) can be used increase the stability of the Xenon ice layer compared to cooling with Nitrogen. Stability of the Xenon ice layer can be important for stable EUV light output and prevention of debris generation. In this regard, tests performed using Nitrogen cooling demonstrated that Xenon ice stability may degrade during continuous source operation. One cause for this might be due to a fine powder that was found to form on the cylinder surface as a result of laser ablation. This, in turn, can reduce ice adhesion and may cause thermal conductivity between the ice and the cylinder to drop and the Xenon ice layer to become less stable over time. As the ice starts to degrade, a much larger Xenon flow may be required to sustain it, which leads to increased EUV absorption losses and also significantly increases cost of operation. A lower Xenon ice temperature is expected to reduce Xenon consumption. Usage of liquid Helium for cylinder cooling can reduce the temperature of the Xenon ice, improve ice stability and/or provide more operational margin.

Figure 10:
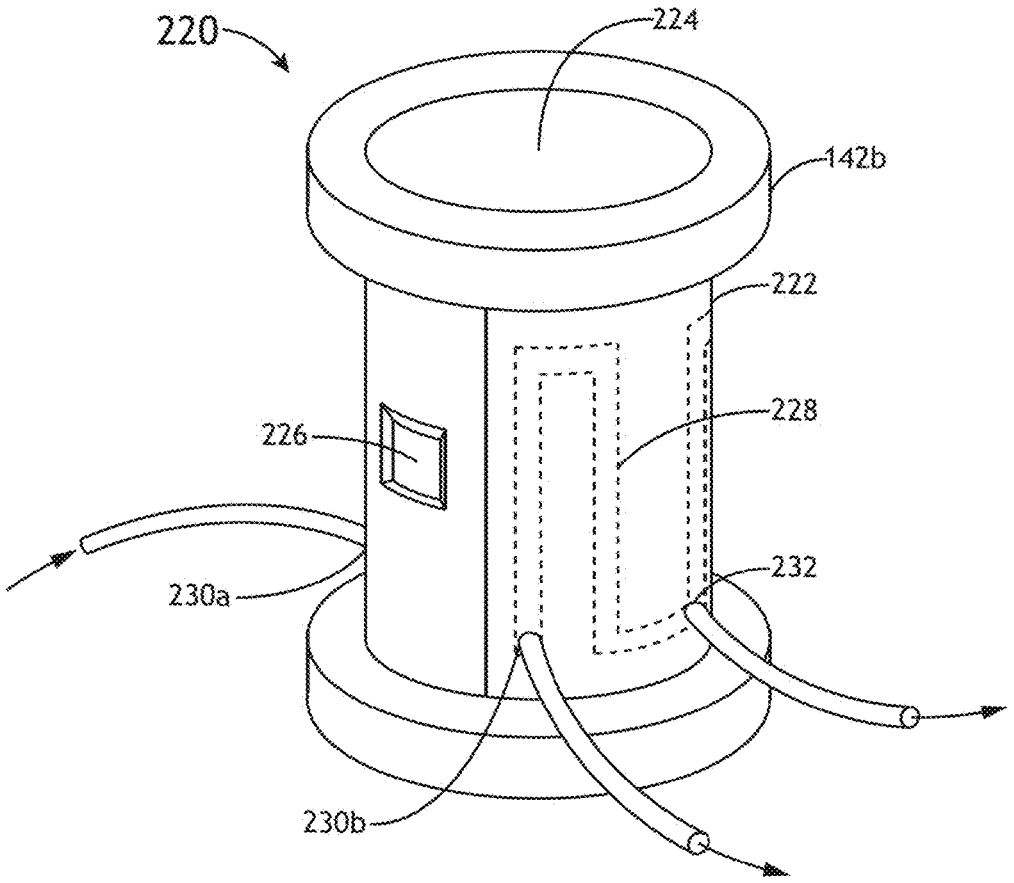
FIG. 10 is a perspective view of a system for cooling a housing.
Figure 11:
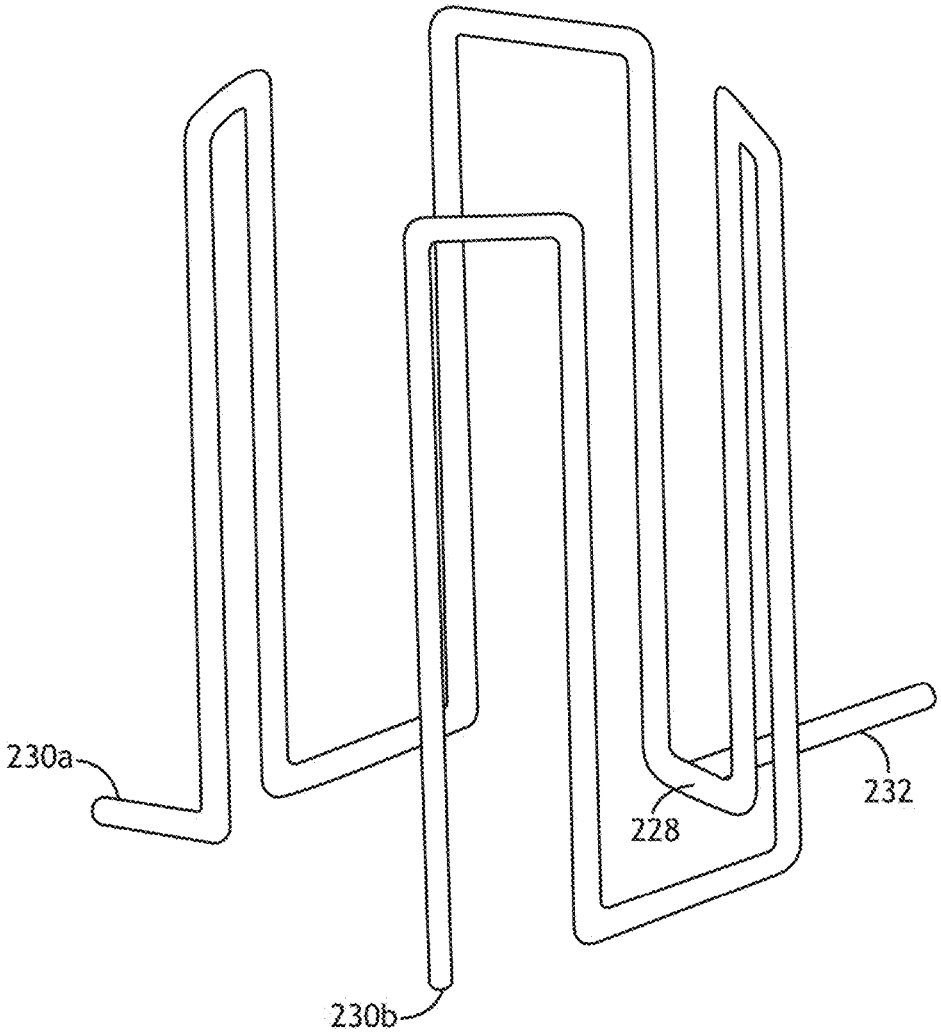
FIG. 11 is a perspective view of an internal passageway for cooling the housing shown in FIG. 10.

FIGS. 10 and 11 show a system 220 for cooling a housing 142*b* which overlays target material 106 (e.g., frozen Xenon) on the surface of a cylindrically-symmetric element, such as the cylindrically-symmetric element 140 shown in FIG. 1. As shown in FIG. 10, housing 142*b* has a cylindrical wall 222 which surrounds a volume 224 for holding a cylindrically-symmetric element and has an opening 226 to allow a beam of radiation to pass through the wall 222 and reach target material 106 on the surface of a cylindrically-symmetric element. The wall 222 is formed with an internal passageway 228 having input port (s) 230*a*, 230*b* and exit port 232. With this arrangement, a cooling fluid can be introduced into the wall 222 at the input port (s) 230*a*, 230*b*, flow through the internal passageway 228 and leave the wall 222 through exit port 232. For example, the cooling fluid can be water, clean dry air, Nitrogen, Argon, or a liquid coolant cooled by a chiller to a temperature less than 0 degrees Celsius. Alternatively, a coolant that has passed through the cylindrically-symmetric element, such as Helium or Nitrogen can be used. For example, coolant exiting the cylindrically-symmetric element 140*e* through port 205 in FIG. 9 can be routed to an input port 230*a*, 230*b* on the housing 142*b*. In some cases, the housing 142*b* can be cooled to improve Xenon ice stability. The housing 142*b* becomes increasingly hotter with the operation of the light source 100 because it is exposed to the laser and plasma radiation. In some instances, the heat buildup may not be dissipated quickly enough because of the vacuum interfaces to the outside world. This temperature rise can increase radiative heating of the Xenon ice and the cylinder and can contribute to increasing instability of the ice layer. In addition, it has been observed in the tests performed by Applicants on the open-loop LN2-cooled drum target that cooling the housing can also result in the reduction of LN2 consumption.

Figure 12:
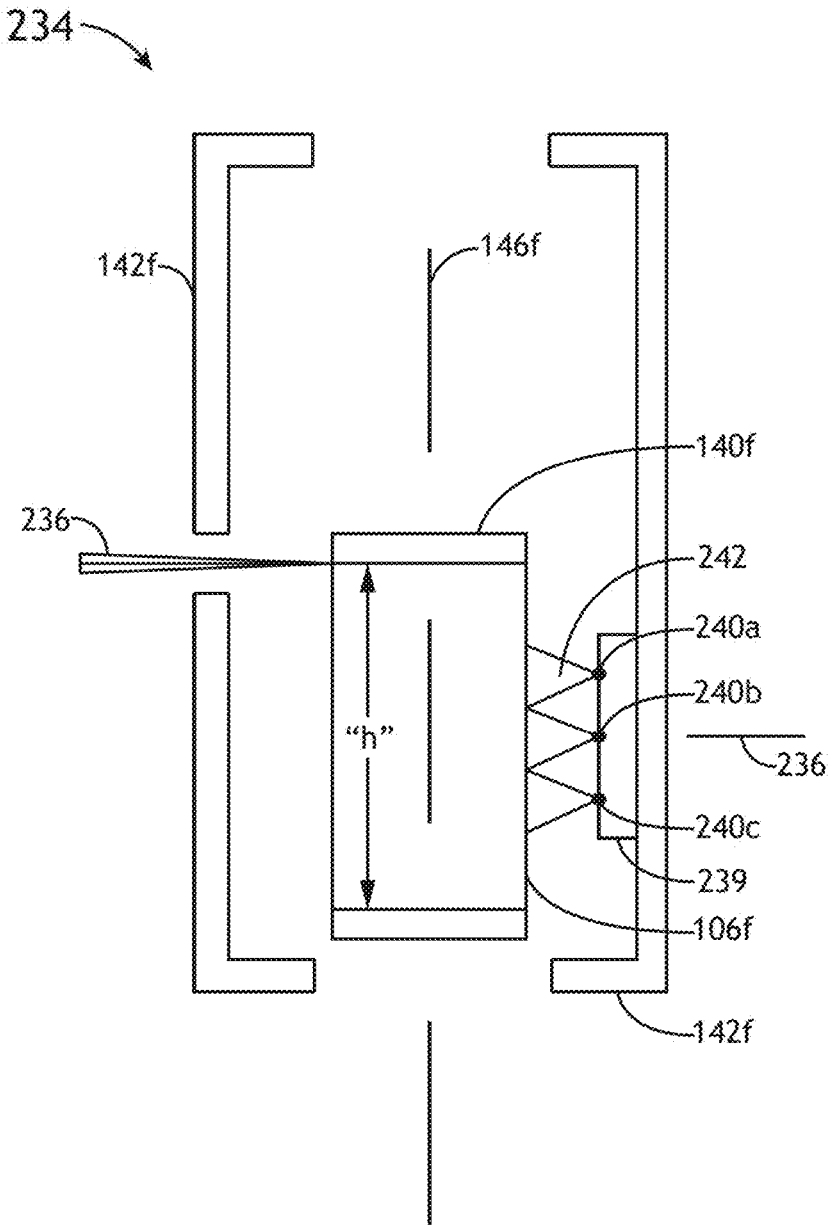
FIG. 12 is a simplified, sectional view of a system for spraying a target material onto a cylindrically-symmetric element, with FIG. 12 showing the cylindrically-symmetric element in a first position.
Figure 13:
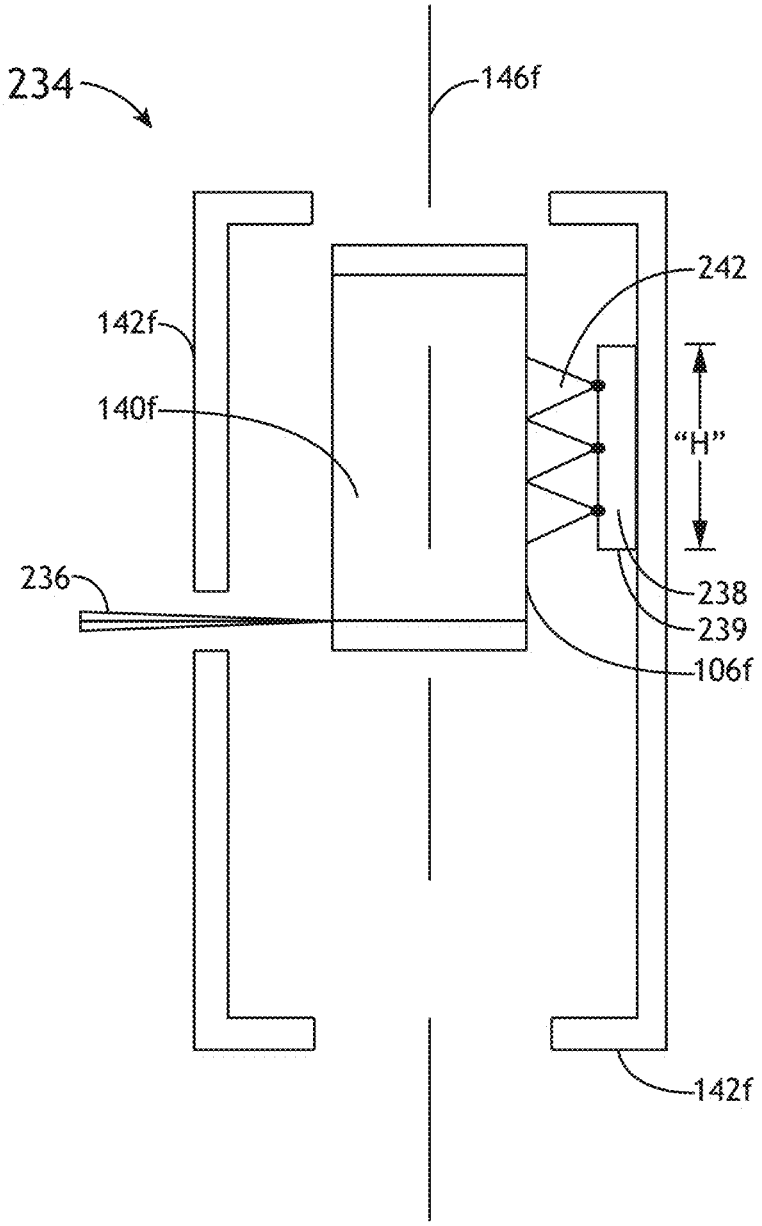
FIG. 13 is a simplified, sectional view of a system for spraying a target material onto a cylindrically-symmetric element, with FIG. 13 showing the cylindrically-symmetric element after axial translation from the first position to a second position.

FIGS. 12 and 13 show a system 234 having a cylindrically-symmetric element 140*f* rotatable about an axis 146*f* and coated with a layer of plasma-forming target material 106*f*. Comparing FIG. 12 to FIG. 13, it can be seen that the cylindrically-symmetric element 140*f* is translatable along the axis 146*f* and relative to the housing 142*f* to define an operational band of target material 106*f* having a band height, h, wherein target material 106*f* within the operational band can be positioned on a laser axis 236 for irradiation by a drive laser. Injection system 238 has an injector 239 which receives target material 106*f* from gas supply system 124 (shown in FIG. 1) and includes a plurality of spray ports 240*a*-240*c*. Although three spray ports 240*a*-240*c* are shown, it is to be appreciated that more than three and as few as one spray port may be employed. As shown, spray ports 240*a-c* are aligned in a direction parallel to the axis 146*f* and the injector 239 is centered on the laser axis 236 and operable to output a spray 242 having a spray height, H, of plasma-forming target material 106*f* with H<h to replenish craters formed in plasma-forming target material 106*f* by irradiation from a drive laser. More specifically, it can be seen that the injector 239 can be mounted at a fixed location on an inner surface of the housing 142*f* which overlays the target material 106*f* on the cylindrically-symmetric element 140*f*. For the example embodiment shown, the injector 239 is mounted on the housing 142*f* to produce a spray 242 that is centered on the laser axis. As the cylindrically-symmetric element 140*f* translates along the axis 146*f*, different portions of the operational band of target material 106*f* receive target material from spray 242, allowing the entire operational band to be coated.

Figure 14:
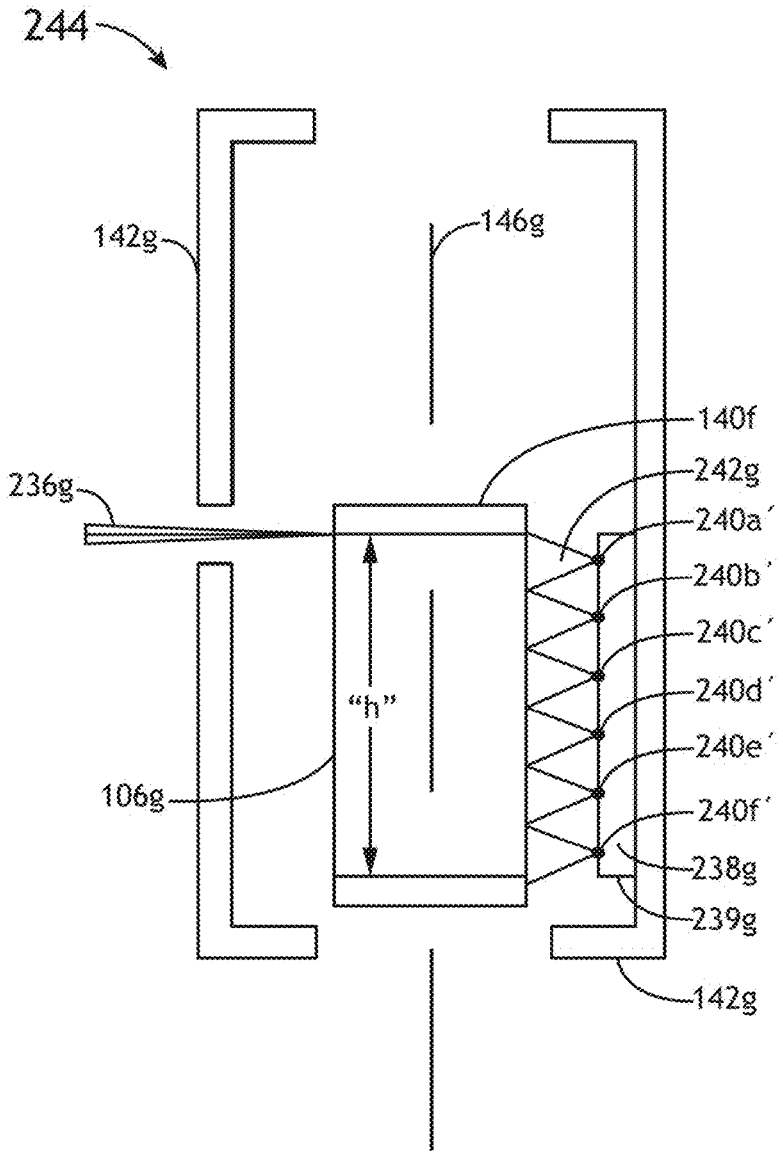
FIG. 14 is a simplified, sectional view of a system for spraying a target material onto a cylindrically-symmetric element having an axially moveable injector, with FIG. 14 showing the cylindrically-symmetric element and injector in respective first positions.
Figure 15:
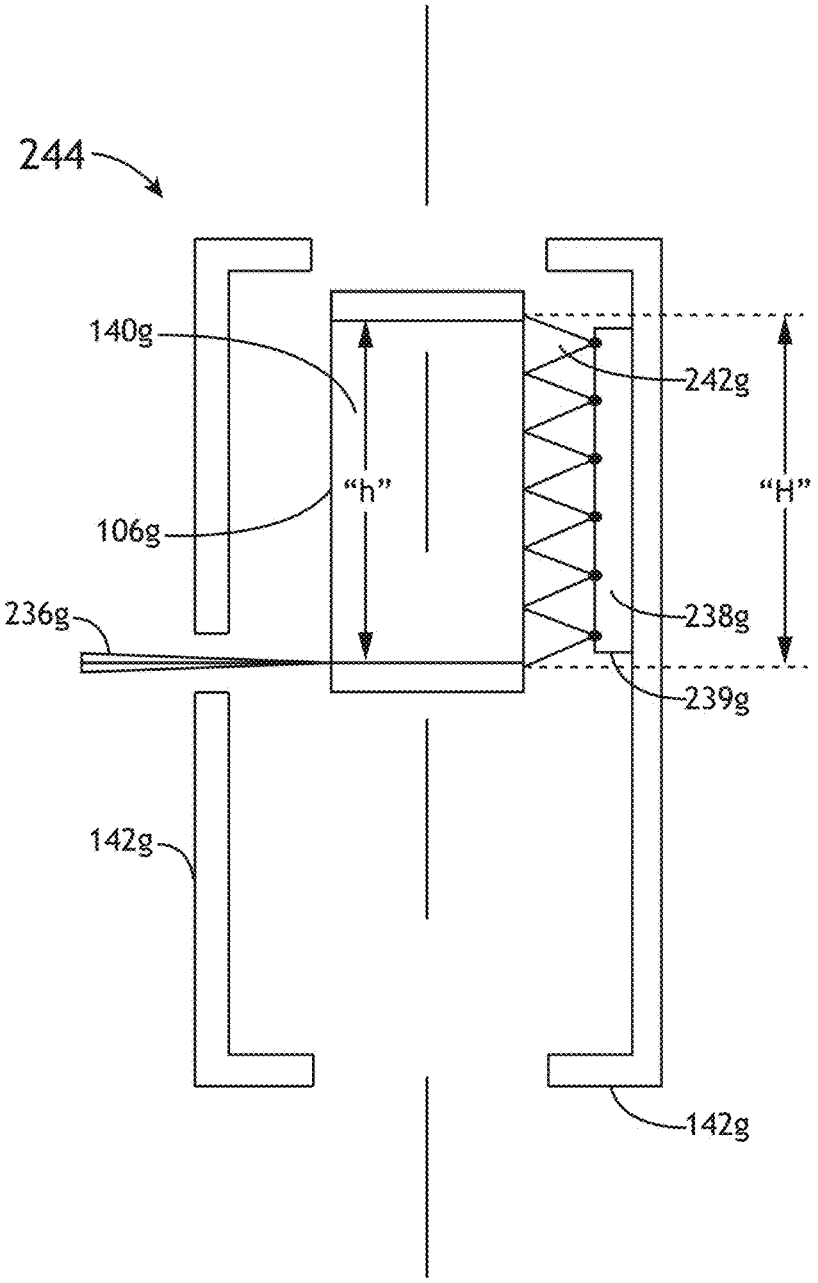
FIG. 15 is a simplified, sectional view of a system for spraying a target material onto a cylindrically-symmetric element having an axially moveable injector, with FIG. 15 showing the cylindrically-symmetric element and injector after axial translation from their respective first positions to respective second positions.

FIGS. 14 and 15 show a system 244 having a cylindrically-symmetric element 140*g* rotatable about an axis 146*g* and coated with a layer of plasma-forming target material 106*g*. Comparing FIG. 14 to FIG. 15, it can be seen that the cylindrically-symmetric element 140*g* is translatable along the axis 146*g* and relative to the housing 142*g* to define an operational band of target material 106*g* having a band height, h, wherein target material 106*g* within the operational band can be positioned on a laser axis 236*g* for irradiation by a drive laser. Injection system 238*g* has an injector 239*g* which receives target material 106*g* from gas supply system 124 (shown in FIG. 1) and includes a plurality of spray ports 240*a*'-240*f*'. Although six spray ports 240*a*'-240*f*' are shown, it is to be appreciated that more than three and as few as one spray port may be employed. As shown, spray ports 240*a*'-240*f*' are aligned in a direction parallel to the axis 146*g* and operable to output a spray 242*g* of plasma-forming target material 106*g* having a spray height, H, to replenish craters formed in plasma-forming target material 106*g* on cylindrically-symmetric element 140*g* by irradiation from a drive laser (i.e., the injection system 238*g* can spray along the entire length of the operational band at once). Moreover, it can be seen that the injector 239*g* can be mounted on an inner surface of the housing 142*g* which overlays the target material 106*g* on the cylindrically-symmetric element 140*g*. Comparing FIGS. 14 and 15, it can be seen that the injector 239*g* can translate relative to the housing 142*g*, and in an embodiment, the movement of the injector 239*g* can be synchronized with the axial translation of the cylindrically-symmetric element 140*g* (i.e., the injector 239*g* and cylindrically-symmetric element 140*g* move together so that the injector 239*g* and cylindrically-symmetric element 140*g* are always in the same position relative to each other). For example, the injector 239*g* and cylindrically-symmetric element 140*g* can be electronically or mechanically (e.g., using a common gear) coupled to move together.

Figure 16:
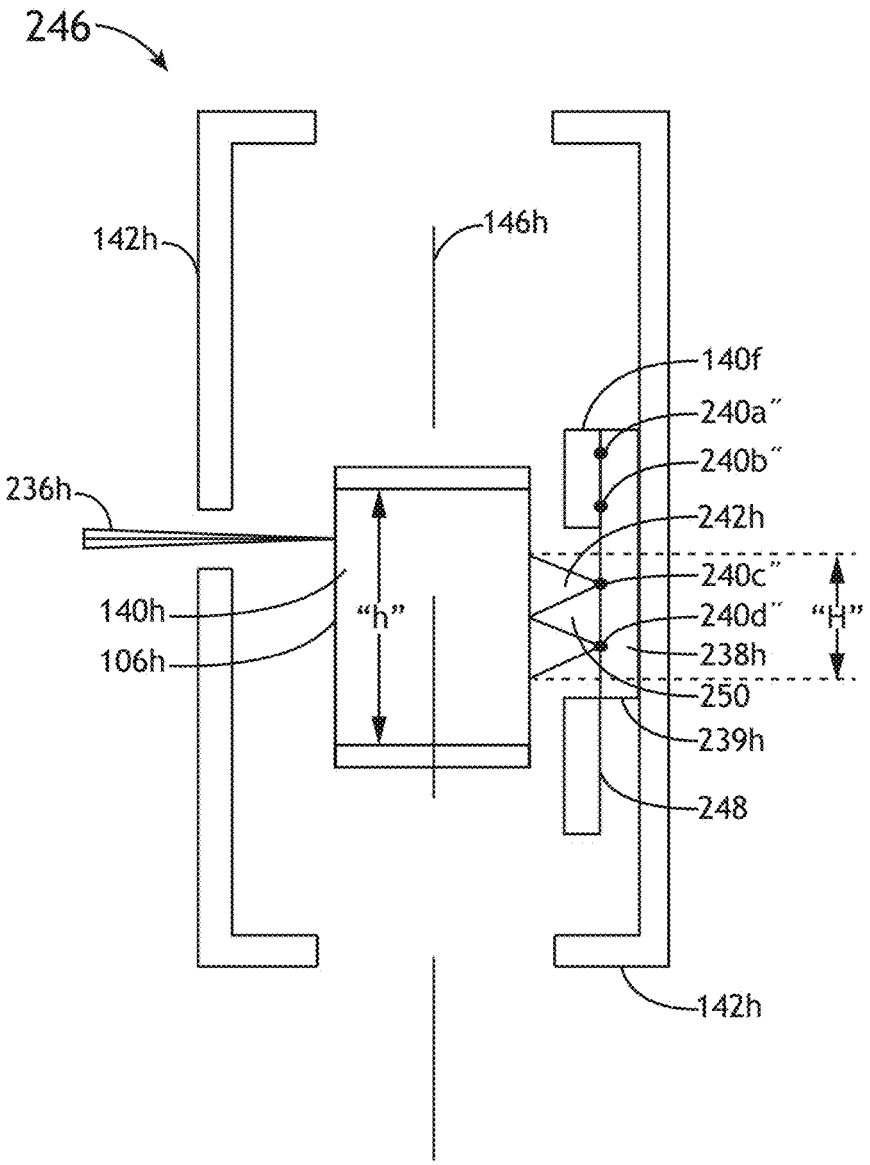
FIG. 16 is a simplified, sectional view of a system for spraying a target material onto a cylindrically-symmetric element having an axially moveable plate having an aperture, with FIG. 16 showing the cylindrically-symmetric element and plate in respective first positions.
Figure 17:
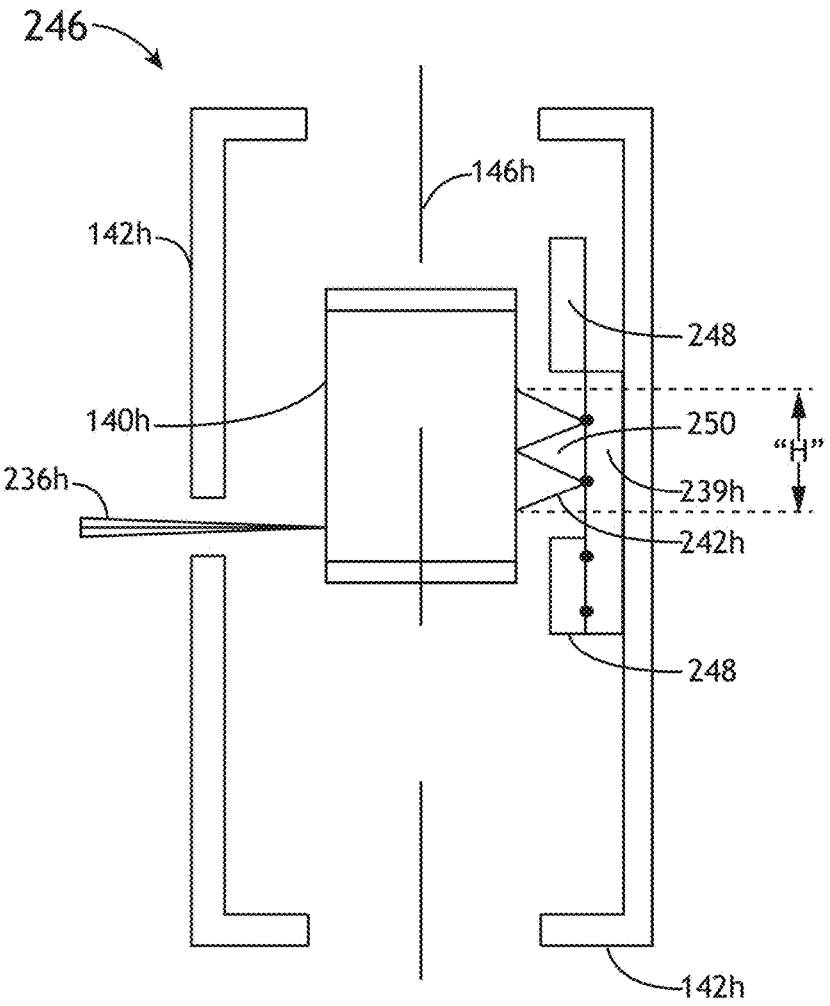
FIG. 17 is a simplified, sectional views of a system for spraying a target material onto a cylindrically-symmetric element having an axially moveable plate having an aperture, with FIG. 17 showing the cylindrically-symmetric element and plate after axial translation from their respective first positions to respective second positions.

FIGS. 16 and 17 show a system 246 having a cylindrically-symmetric element 140*h* rotatable about an axis 146*h* and coated with a layer of plasma-forming target material 106*h*. Comparing FIG. 16 to FIG. 17, it can be seen that the cylindrically-symmetric element 140*h* is translatable along the axis 146*h* and relative to the housing 142*h* to define an operational band of target material 106*h* having a band height, h, wherein target material 106*h* within the operational band can be positioned on a laser axis 236*h* for irradiation by a drive laser. Injection system 238*h* has an injector 239*h* which receives target material 106*h* from gas supply system 124 (shown in FIG. 1) and includes a plurality of spray ports 240*a*"-240*d*". Although four spray ports 240*a*"-d" are shown, it is to be appreciated that more than four and as few as two spray ports may be employed.

Continuing with reference to FIGS. 16 and 17, it can be seen that spray ports 240*a*"-240*d*" are aligned in a direction parallel to the axis 146*h*. Also shown, the injector 239*h* can be mounted at a fixed location on an inner surface of the housing 142*h* which overlays the target material 106*h* on the cylindrically-symmetric element 140*h*. In an embodiment, the injector 239*h* can be centered on the laser axis 236*h*, as shown in FIG. 16. The system 246 can also include a plate 248 that is formed with an aperture 250. Comparing FIGS. 16 and 17, it can be seen that the blocking plate 248 (and aperture 250) can translate relative to the housing 142*h*, and in an embodiment, the movement of the plate 248 can synchronized with the axial translation of the cylindrically-symmetric element 140*h* (i.e., the plate 248 and cylindrically-symmetric element 140*h* move together so that the plate 248 and cylindrically-symmetric element 140*h* are always in the same position relative to each other). For example, the plate 248 and cylindrically-symmetric element 140*h* can be electronically or mechanically (e.g., using a common gear) coupled to move together. More specifically, the plate 248 and aperture 250 can be translated in a direction parallel to the axis 146*h* to selectively cover and uncover spray ports spray ports 240*a*"-240*d*". For example, it can be seen that in FIG. 16, spray ports 240*a*", 240*b*" are covered by plate 248 and spray ports 240*c*", 240*d*" are uncovered, thus allowing spray ports 240*c*", 240*d*" to output a spray 242*h* of plasma-forming target material 106*h* having a spray height, H, to replenish craters that have been formed in plasma-forming target material 106*h* on cylindrically-symmetric element 140*h* by irradiation from a drive laser (i.e., the injection system 238*h* can spray along the entire length of the operational band at once). It can also be seen from FIGS. 16 and 17 that after a translation of the plate 248, aperture 250 and cylindrically-symmetric element 140*h*, (see FIG. 17) spray ports 240*c*", 240*d*" are covered by plate 248 and spray ports 240*a*", 240*b*" are uncovered, thus allowing spray ports 240*a*", 240*b*" to output a spray 242*h*' of plasma-forming target material 106 (also having a spray height, H).

The optimized Xenon injection scheme shown in FIGS. 12-17 can reduce Xenon consumption for ice growth/replenishment and can be used to ensure that the craters formed in the target material ice layer by the laser are filled quickly.

Figure 18:
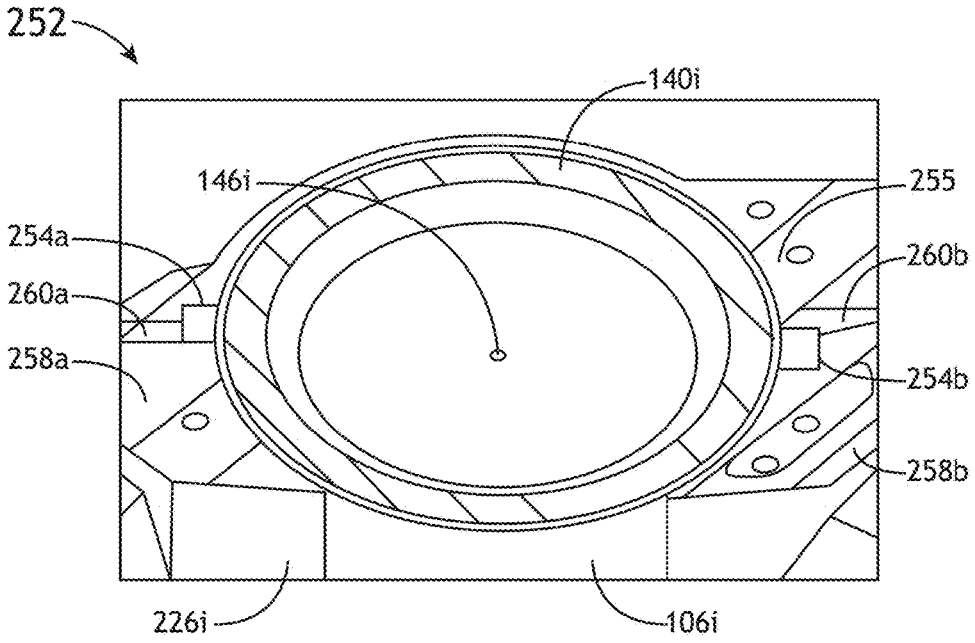
FIG. 18 is a perspective, sectional view of a wiper system.

FIG. 18 shows a system 252 having a cylindrically-symmetric element 140*i* rotatable about an axis 146*i* and coated with a layer of plasma-forming target material 106*i*. A subsystem (for example, one of the systems shown in FIGS. 12-17) can be provided for replenishing plasma-forming target material 106*i* on the cylindrically-symmetric element 140*i*. Cross referencing FIGS. 18, 19 and 20A, it can be seen that a pair of serrated wipers 254*a*, 254*b* can be positioned to scrape plasma-forming target material 106*i* on the cylindrically-symmetric element 140*i* to establish a uniform thickness of plasma-forming target material 106*i*. For example, wiper 254*a* can be a lead wiper and wiper 254*b* can be a trailing wiper with the edge of the lead wiper slightly closer to the axis 146*i* than the edge of the trailing wiper. Lead wiper 254*a* is the first wiper that touches newly added target material (e.g., Xenon) which is added via port 255. Although two wipers 254*a*, 254*b* are shown and described herein, it is to be appreciated that more than two wipers and as few as one wiper may be employed. Moreover, the wipers may be equally spaced around the circumference of the cylindrically-symmetric element 140*i*, as shown, or some other arrangement may be employed (e.g., two wipers proximate each other).

Figure 19:
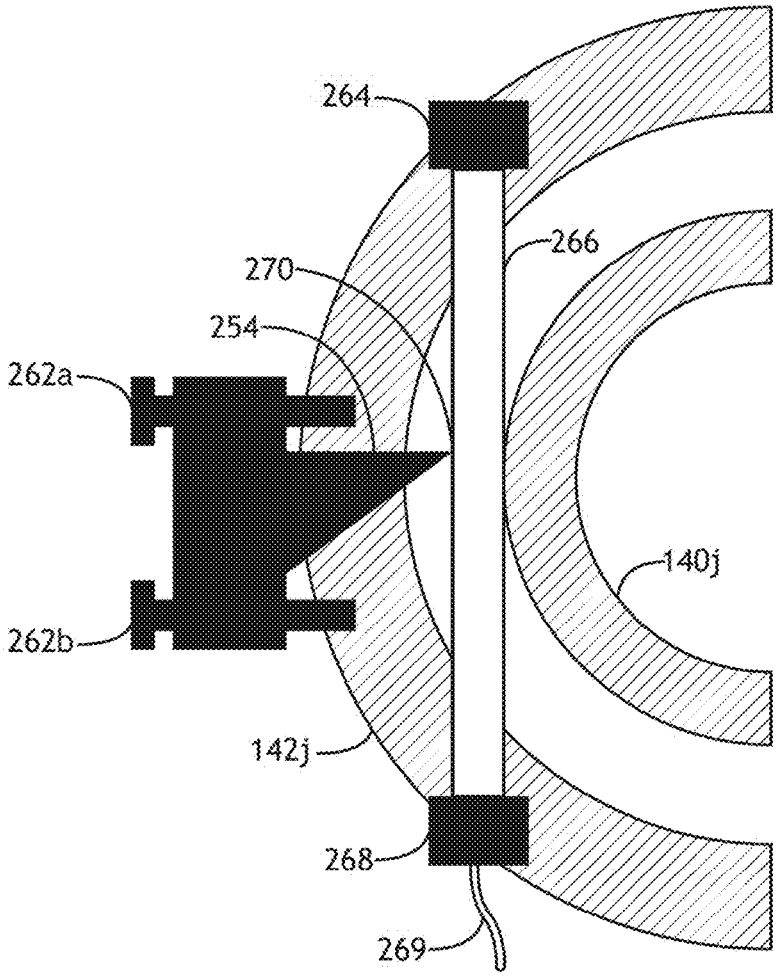
FIG. 19 is a perspective view of a serrated wiper having three teeth.
Figure 20A:
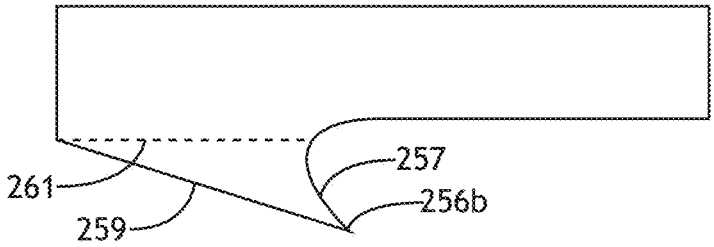
FIG. 20A is a sectional view as seen along ling 19A-19A in FIG. 20B showing a tooth, rake angle, clearance angle and relief cut.
Figure 20B:
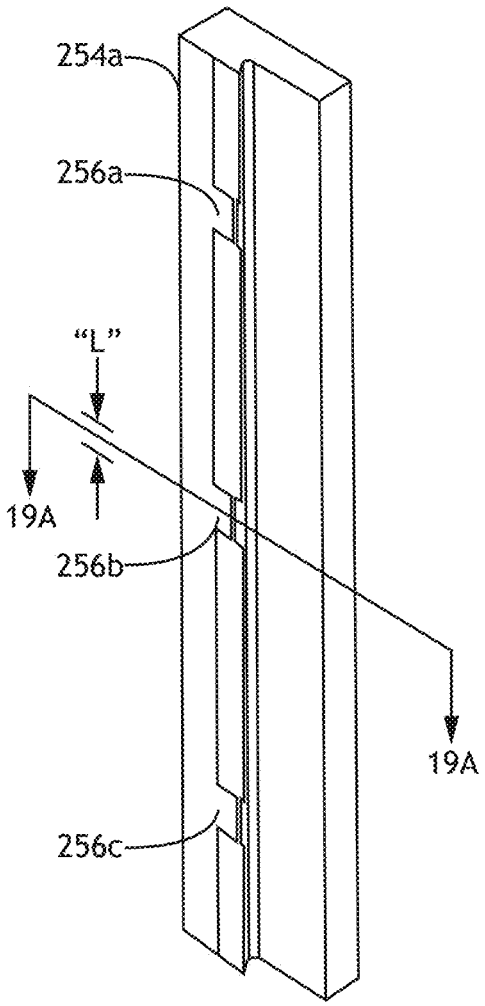
FIG. 20B is a sectional view of a measurement system for determining the position of a wiper relative to a drum.

Each serrated wiper, such as serrated wiper 254*a* shown in FIGS. 18 and 19, can include three cutting teeth 256*a*-256*c* that are spaced apart and aligned axially in a direction parallel to the axis 146*i*. Although three teeth 256*a*-256*c* are shown and described herein, it is to be appreciated that more than three cutting teeth and as few as one cutting tooth may be employed. FIG. 20A shows tooth 256*b*, rake angle 257, clearance angle 259 and relief cut 261. Also, it can be seen in FIG. 20B that each tooth 256*a*-256*c* has a length, L. Generally, the teeth 256*a*-256*c* are sized to have a length, L, greater than a crater formed when a laser pulse irradiates target material 106*i* to ensure proper coverage of the crater. In an embodiment, a serrated wiper can be used having at least two teeth, each tooth having a length, L, in a direction parallel to the axis 146*i*, with L>3×D. where D is a maximum diameter of a crater formed when a laser pulse irradiates target material 106*i*. Serrated wipers can reduce the load on the cylindrically-symmetric element 140*i* and shaft. In an embodiment, the total contact area is chosen as small as possible, and chosen not to exceed the maximum stiffness of the system. Experimental measurements conducted by Applicant have shown that the load from the serrated wipers can be greater than five times (>5×) less than from the conventional non-serrated wipers. In an embodiment, the thickness of the teeth is sized to be less than their length, L, to ensure good mechanical support and prevent breaking and the length, L, is chosen to be less than the spacing between the teeth. In an embodiment, the wiper is designed such that the teeth are able to scrape all the area of the Xenon ice irradiated by the laser as the target translates up and down. The wiper can have additional teeth, in contact with the ice located outside of the exposed area to prevent ice buildup outside of the exposed area. These additional teeth may be smaller than the teeth used to scrape the area of the Xenon ice irradiated by the laser.

FIG. 18 shows that the wipers 254*a*, 254*b* can be mounted in respective modules 258*a*, 258*b* which can form modular, detachable portions of a housing, such as housing 142 shown in FIG. 1. With this arrangement, modules 258*a*, 258*b* can be detached to replace wipers without necessarily requiring disassembly and removal of the entire housing and/or other housing related components such as the injectors shown in FIGS. 12-17. Wipers 254*a*, 254*b* can be mounted in respective modules 258*a*, 258*b* using adjustable screws 260*a*, 260*b* having an access point on an exposed surface of the housing module to allow adjustment while the cylindrically-symmetric element 140*i* is coated with target material 106*i* (under vacuum conditions) and rotating. The above described modular design and exposed surface access point are also applicable to non-serrated wipers (i.e., a wiper having a single, continuous, cutting edge). In some cases, the wiper can establish a gas seal between the housing and the plasma-forming target material to reduce the release of target material gas into the LPP chamber. The wipers can not only control the thickness of the Xenon ice, but can also form a partial dam to reduce the amount of replenishment Xenon injected on the non-exposure side of the cylinder from flowing around the cylinder and escaping to the exposure side of the cylinder. These wipers can be full-length, constant height wipers or can be serrated wipers. In both cases, the wiper position can be adjusted within the wiper mount to place them in the correct location relative to the cylinder. More specifically, as shown in FIG. 18, wiper 254*a* can be positioned on a first side of target material replenishment port 255 and between the port 255 and housing opening 226*i* to prevent leakage of target material (e.g., Xenon gas) through housing opening 226*i*, and wiper 254*b* can be positioned on a second side (opposite the first side) of target material replenishment port 255 and between the port 255 and housing opening 226*i* to prevent leakage of target material (e.g., Xenon gas) through housing opening 226*i*.

FIG. 19 shows a wiper 254, which can be a serrated or non-serrated wiper which is adjustably attached to housing 142*j* via adjustment screws 262*a*, 262*b*. FIG. 19 also shows a measurement system having a light emitter 264 sending a beam 266 to a light sensor 268 which can output a signal over line 269 indicative of a radial distance between wiper edge 270 and the rotation axis (e.g., axis 146*i* in FIG. 10) of cylindrically-symmetric element 140*j*. For example, the line 269 can connect the measurement system for communication with the control system 120 shown in FIG. 1.

Figure 21:
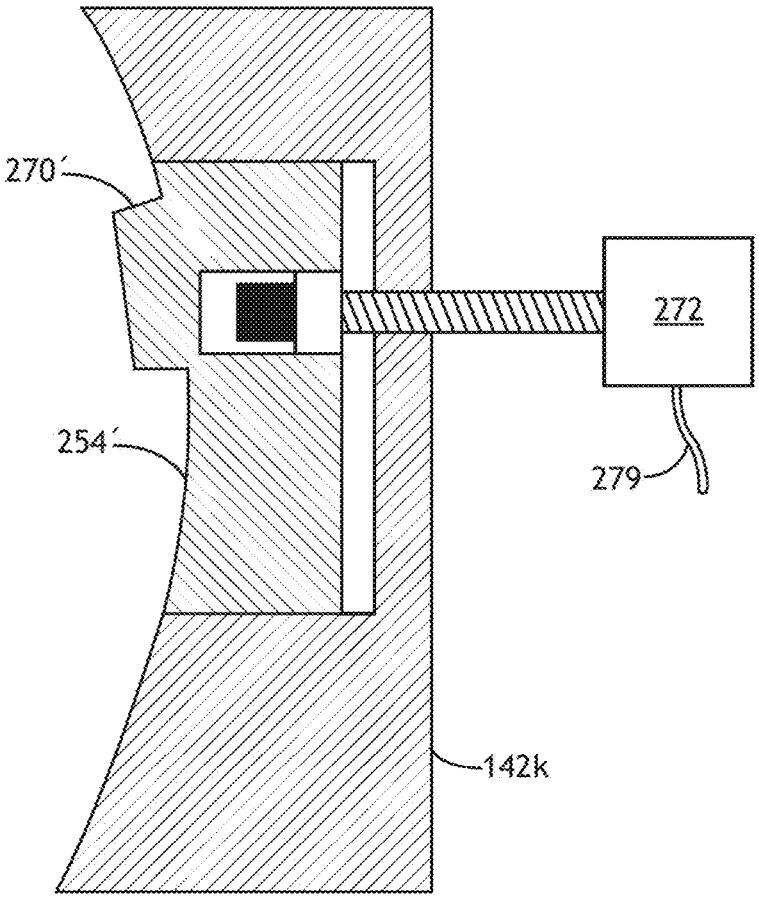
FIG. 21 is a sectional, schematic view of a wiper adjustment system having an actuator for moving the wiper.

FIG. 21 shows wiper 254' which can be a serrated or non-serrated wiper which is adjustably attached to housing 142*k*. FIG. 21 also shows an adjustment system for adjusting a radial distance between the wiper edge 270' and the rotation axis (e.g., axis 146*i* of cylindrically-symmetric element 140*i* in FIG. 10). As shown, the adjustment system has an actuator 272, (which can be, for example, a linear actuator such as a lead screw, stepper motor, servo motor, etc.) for moving the wiper 254' in response to a control signal received over line 274. For example, the line 274 can connect the adjustment system for communication with the control system 120 shown in FIG. 1.

Figure 22:
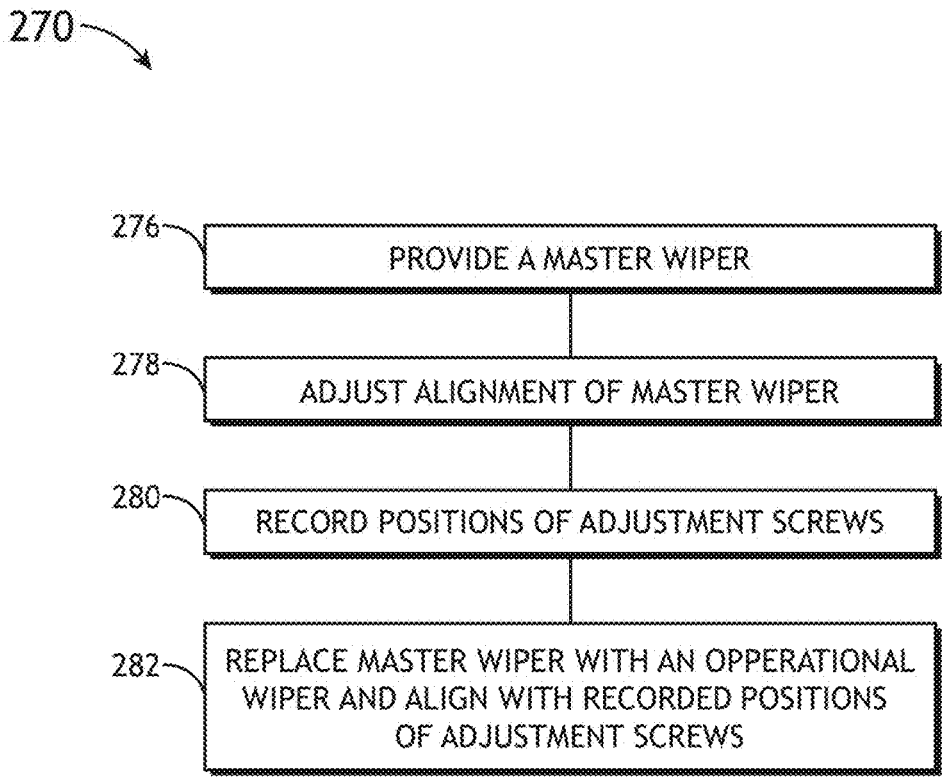
FIG. 22 is a flowchart illustrating the steps involved in a wiper alignment technique that employs a master wiper.

FIG. 22 illustrates the steps for using a system for mounting a wiper. As shown, box 276 involves the step of providing a master wiper which is produced to exacting tolerances. Next, as shown in box 278, the master wiper is mounted in a wiper mount and its alignment is adjusted using, for example, adjustment screws. The screw positions (e.g., number of turns) is then recorded (box 280). The master wiper is then replaced with an operational wiper (box 282) which is produced having standard (e.g., good) machining tolerances.

Figure 23:
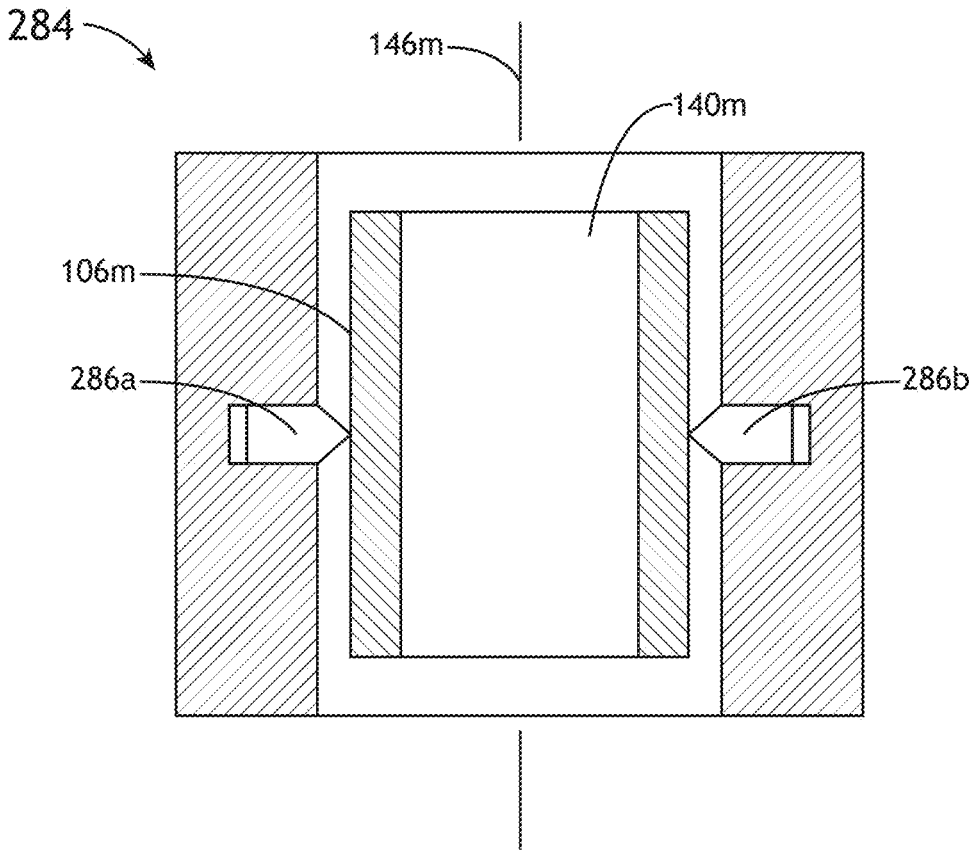
FIG. 23 is a sectional view of a compliant wiper system.

FIG. 23 shows a system 284 having a cylindrically-symmetric element 140*m* rotatable about an axis 146*m* and coated with a layer of plasma-forming target material 106*m*. A subsystem (for example, one of the systems shown in FIGS. 12-17) can be provided for replenishing plasma-forming target material 106*m* on the cylindrically-symmetric element 140*m*. FIG. 23 further shows that a pair of compliant wipers 286*a*, 286*b* can be positioned to contact plasma-forming target material 106*m* on the cylindrically-symmetric element 140*m* to establish a uniform thickness of plasma-forming target material 106*m* having a relatively smooth surface. More specifically, as shown, wiper 286*a* can be positioned at a location that is diametrically opposite the position of wiper 286*b*, across the cylindrically-symmetric element 140*m*. Functionally, the heated wipers 286*a*, 286*b* can each act somewhat like the blade of an ice skate, locally increasing pressure and heat flow into the ice. By using an opposing pair of compliant wipers, the forces from the two sides of the cylindrically-symmetric element 140*m* are effectively matched, reducing the net unbalancing force on the cylindrically-symmetric element 140*m*. This can reduce the risk of damage to a bearing system, such as the air bearing system described above, and can, in some instances, eliminate the need for a second end side bearing.

Figure 24:
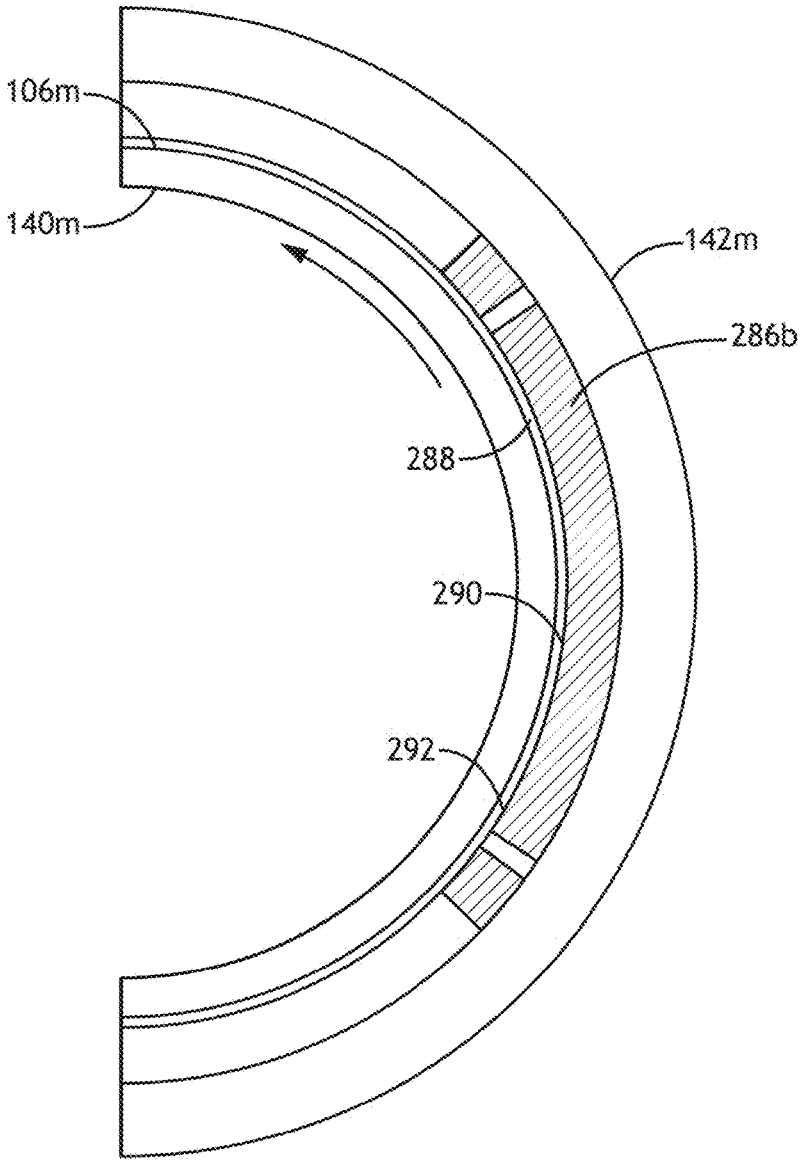
FIG. 24 is a sectional view showing a compliant wiper in operational position relative to a drum coated with target material.

FIG. 24 shows the curvature of the wiper 286*b* relative to the cylindrically-symmetric element 140*m*. Specifically, as shown, the wiper 286*b* has a curved compliant surface 288 which is shaped to contact target material 106*m* on cylindrically-symmetric element 140*m* at the center 290 of the wiper 286*b* and establish a gap between the curved compliant surface 288 and target material 106*m* on cylindrically-symmetric element 140*m* at the end 292 of the wiper 286*b*. The material used to establish the surface 288 of the compliant wiper 286*b* can be, for example, one of several hardenable stainless steels, titanium, or a titanium alloy.

Figure 25A:
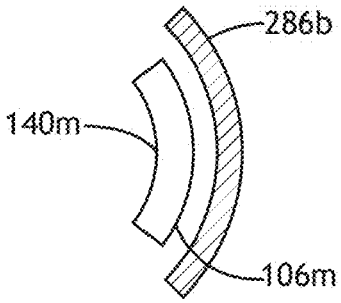
FIG. 25A illustrates the growth of target material on a drum in a compliant wiper system.
Figure 25B:
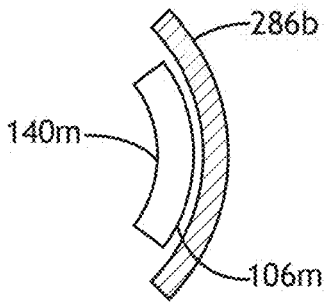
FIG. 25B illustrates the growth of target material on a drum in a compliant wiper system.
Figure 25C:
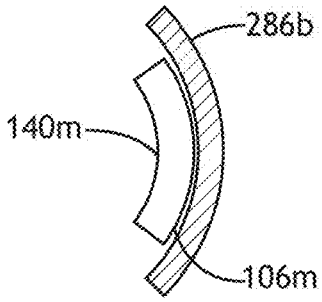
FIG. 25C illustrates the growth of target material on a drum in a compliant wiper system.

FIGS. 25A-C illustrate the growth of target material 106*m*, with FIG. 25A showing an initial growth that does not contact the compliant wiper 286*b*. Later, as shown in FIG. 25B, the target material 106*m* has grown and initially contacts the wiper 286*b*. Still later, further growth of the target material 106*m* brings it into contact with the wiper surface and causes it to deform elastically, pushing back against the target material layer until it reaches an equilibrium state when the pressure from the wiper causes the layer material to locally melt and reflow to form a uniform surface. In other words, the curved wiper can flex to allow increased Xenon ice thickness, and stops flexing when an equilibrium is reached between the force exerted by the wiper on the cylinder of Xenon ice and the force caused by the replenishment of the Xenon ice. A servo function can be used on these curved wipers to deal with the temperature control of the wipers. For example, a camera can be provided to monitor ice thickness and each wiper can contain a heater and a temperature sensor and the temperature can be held at a fixed value to establish an equilibrium thickness of the Xenon ice.

Figure 26:
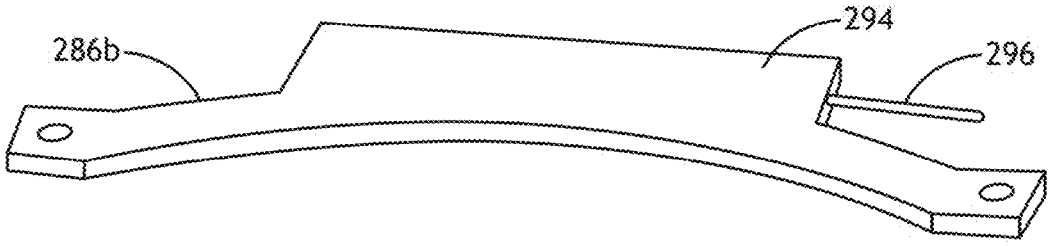
FIG. 26 is a perspective view of a compliant wiper having a heat cartridge and thermocouple.

FIG. 26 shows that the compliant wiper 286*b* can include a heater cartridge 294 and thermocouple 296 for controllably heating the wiper 286*b*. For example, the heater cartridge 294 and thermocouple 296 can be connected in communication with the control system 120 shown in FIG. 1 to maintain the wiper 286*b* at a selected temperature.

Figure 27:
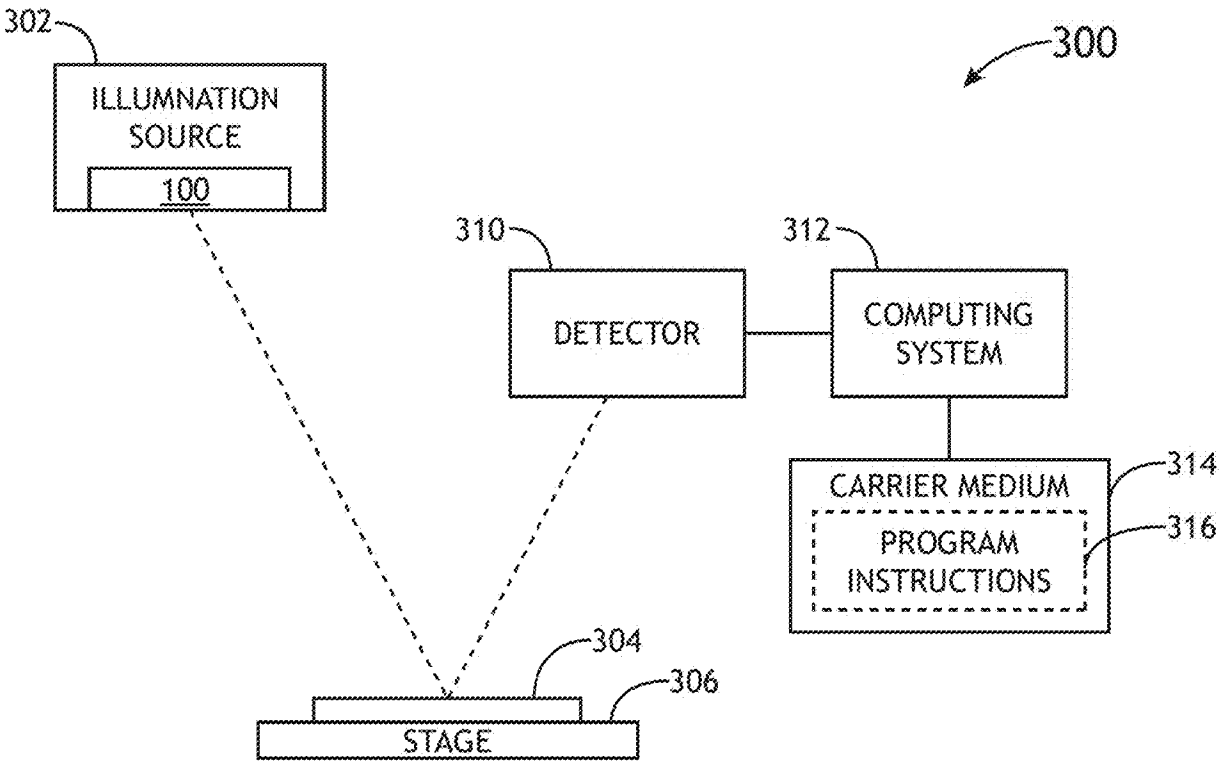
FIG. 27 is a simplified schematic diagram illustrating an inspection system incorporating a light source as disclosed herein.

Light source illumination may be used for semiconductor process applications, such as inspection, photolithography, or metrology. For example, as shown in FIG. 27, an inspection system 300 may include an illumination source 302 incorporating a light source, such as a light source 100 described above having one of the target delivery systems described herein. The inspection system 300 may further include a stage 306 configured to support at least one sample 304, such as a semiconductor wafer or a blank or patterned mask. The illumination source 302 may be configured to illuminate the sample 304 via an illumination path, and illumination that is reflected, scattered, or radiated from the sample 304 may be directed along an imaging path to at least one detector 310 (e.g., camera or array of photo-sensors). A computing system 312 that is communicatively coupled to the detector 310 may be configured to process signals associated with the detected illumination signals to locate and/or measure various attributes of one or more defects of the sample 304 according to an inspection algorithm embedded in program instructions 316 executable by a processor of the computing system 312 from a non-transitory carrier medium 314.

Figure 28:
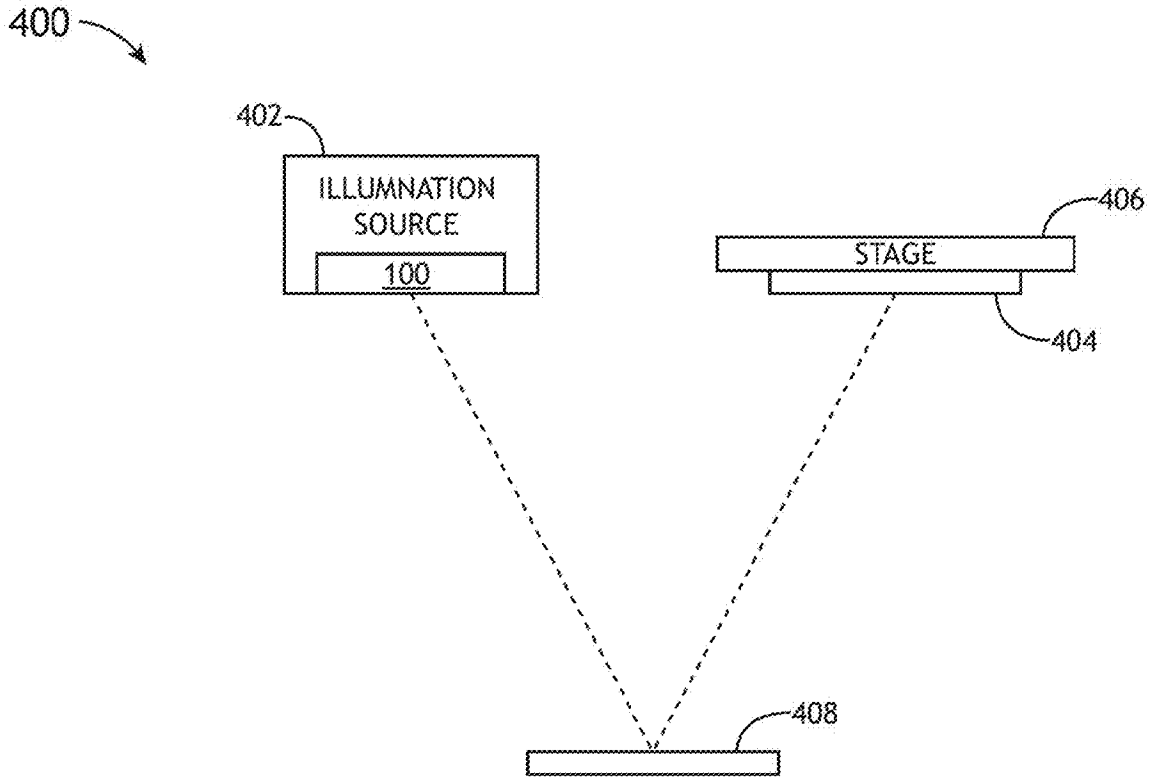
FIG. 28 is a simplified schematic diagram illustrating a lithography system incorporating a light source as disclosed herein.

For further example, FIG. 28 generally illustrates a photolithography system 400 including an illumination source 402 incorporating a light source, such as a light source 100 described above having one of the target delivery systems described herein. The photolithography system may include a stage 406 configured to support at least one substrate 404, such as a semiconductor wafer, for lithography processing. The illumination source 402 may be configured to perform photolithography upon the substrate 404 or a layer disposed upon the substrate 404 with illumination output by the illumination source 402. For example, the output illumination may be directed to a reticle 408 and from the reticle 408 to the substrate 404 to pattern the surface of the substrate 404 or a layer on the substrate 404 in accordance with an illuminated reticle pattern. The exemplary embodiments illustrated in FIGS. 27 and 28 generally depict applications of the light sources described above; however, those skilled in the art will appreciate that the sources can be applied in a variety of contexts without departing from the scope of this disclosure.

Those having skill in the art will further appreciate that there are various vehicles by which processes and/or systems and/or other technologies described herein can be effected (e.g., hardware, software, and/or firmware), and that the preferred vehicle will vary with the context in which the processes and/or systems and/or other technologies are deployed. In some embodiments, various steps, functions, and/or operations are carried out by one or more of the following: electronic circuits, logic gates, multiplexers, programmable logic devices, ASICs, analog or digital controls/switches, microcontrollers, or computing systems. A computing system may include, but is not limited to, a personal computing system, mainframe computing system, workstation, image computer, parallel processor, or any other device known in the art. In general, the term "computing system" is broadly defined to encompass any device having one or more processors, which execute instructions from a carrier medium. Program instructions implementing methods such as those described herein may be transmitted over or stored on carrier media. A carrier medium may include a transmission medium such as a wire, cable, or wireless transmission link. The carrier medium may also include a storage medium such as a read-only memory, a random access memory, a magnetic or optical disk, or a magnetic tape.

All of the methods described herein may include storing results of one or more steps of the method embodiments in a storage medium. The results may include any of the results described herein and may be stored in any manner known in the art. The storage medium may include any storage medium described herein or any other suitable storage medium known in the art. After the results have been stored, the results can be accessed in the storage medium and used by any of the method or system embodiments described herein, formatted for display to a user, used by another software module, method, or system, etc. Furthermore, the results may be stored "permanently," "semi-permanently," "temporarily", or for some period of time. For example, the storage medium may be random access memory (RAM), and the results may not necessarily persist indefinitely in the storage medium.

Although particular embodiments of this invention have been illustrated, it is apparent that various modifications and embodiments of the invention may be made by those skilled in the art without departing from the scope and spirit of the foregoing disclosure. Accordingly, the scope of the invention should be limited only by the claims appended hereto.

What is claimed is:

1. A device comprising:

a stator body;

a cylindrically-symmetric element rotatable about an axis and having a surface coated with plasma-forming target material for irradiation by a drive laser to produce plasma in a laser produced plasma (LPP) chamber, the element extending from a first end to a second end;

a gas bearing assembly coupling the first end of the cylindrically-symmetric element to the stator body, the gas bearing assembly establishing a bearing gas flow and having a system reducing leakage of bearing gas into the LPP chamber by introducing a barrier gas into a first space in fluid communication with the bearing gas flow; and a second bearing assembly coupling the second end of the cylindrically-symmetric element to the stator body, the second bearing having a system reducing leakage of contaminant material from the second bearing into the LPP chamber by introducing a barrier gas into a second space in fluid communication with the second bearing.

2. The device of claim 1, wherein the second bearing assembly is a magnetic bearing and the contaminant material comprises contaminants generated by the magnetic bearing.

3. The device of claim 1, wherein the second bearing assembly is a greased bearing and the contaminant material comprises contaminants generated by the greased bearing.

4. The device of claim 1, wherein the second bearing assembly is a gas bearing assembly and the contaminant material is bearing gas.

5. The device of claim 1, wherein the cylindrically-symmetric element is mounted on a spindle and the system reducing leakage of bearing gas into the LPP chamber comprises a first annular groove, in one of the stator body and the spindle, in fluid communication with the first space and arranged to vent the bearing gas, at a first pressure, from a first portion of the first space; a second annular groove, in one of the stator body and the spindle, in fluid communication with the first space and arranged to transport a barrier gas, at a second pressure, into a second portion of the first space; and, a third annular groove, in one of the stator body and the spindle, in fluid communication with the first space, the third annular groove disposed between the first and second annular grooves in an axial direction parallel to the axis; and, arranged to transport the bearing gas and the barrier gas out of a third portion of the first space to create, in the third portion, a third pressure less than the first pressure and the second pressure.

6. The device of claim 1, wherein the cylindrically-symmetric element is mounted on a spindle and the system reducing leakage of contaminant material into the LPP chamber comprises a first annular groove, in one of the stator body and the spindle, in fluid communication with the first space and arranged to vent contaminant material, at a first pressure, from a first portion of the first space; a second annular groove, in one of the stator body and the spindle, in fluid communication with the first space and arranged to transport a barrier gas, at a second pressure, into a second portion of the first space; and, a third annular groove, in one of the stator body and the spindle, in fluid communication with the first space, the third annular groove disposed between the first and second annular grooves in an axial direction parallel to the axis; and, arranged to transport the contaminant material and the barrier gas out of a third portion of the first space to create, in the third portion, a third pressure less than the first pressure and the second pressure.

7. The device of claim 1, further comprising a drive unit at the first end of the cylindrically-symmetric element, the drive unit having a linear motor assembly for translating the cylindrically-symmetric element along the axis and a rotary motor for rotating the cylindrically-symmetric element about the axis.

8. The device of claim 1, wherein the plasma-forming target material in Xenon ice.

9. The device of claim 1, wherein the bearing gas is selected from the group of gasses consisting of Nitrogen, Oxygen, purified air, Xenon, and Argon.

10. The device of claim 1, wherein the barrier gas is selected from the group of gasses consisting of Xenon and Argon.

* * * * *